US009062916B2

(12) United States Patent
Bringe et al.

(10) Patent No.: US 9,062,916 B2
(45) Date of Patent: Jun. 23, 2015

(54) HOUSEHOLD APPLIANCE HAVING A THERMOSTAT RETAINER FOR A THERMOSTAT OF A WARMING DRAWER

(75) Inventors: William Bringe, Powell, TN (US); Samuel Harward, Knoxville, TN (US); Michael Rutherford, Duff, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 481 days.

(21) Appl. No.: 13/483,092

(22) Filed: May 30, 2012

(65) Prior Publication Data

US 2013/0323662 A1 Dec. 5, 2013

(51) Int. Cl.

| | |
|---|---|
| ***F24C 7/06*** | (2006.01) |
| ***F24C 15/18*** | (2006.01) |
| ***H05B 3/22*** | (2006.01) |
| ***H05B 3/26*** | (2006.01) |
| ***F27D 1/00*** | (2006.01) |
| ***F24C 7/08*** | (2006.01) |
| ***F24C 15/00*** | (2006.01) |
| *H05B 3/68* | (2006.01) |

(52) U.S. Cl.

CPC ... *F27D 1/00* (2013.01); *F24C 7/06* (2013.01); *F24C 7/08* (2013.01); *F24C 15/18* (2013.01); *H05B 3/262* (2013.01); *H05B 3/68* (2013.01); *F24C 15/00* (2013.01)

(58) Field of Classification Search

None

See application file for complete search history.

(56) References Cited

U.S. PATENT DOCUMENTS

| | | | | |
|---|---|---|---|---|
| 2,976,386 | A * | 3/1961 | Salton | 219/450.1 |
| 3,317,709 | A * | 5/1967 | Beasley | 219/448.17 |
| 3,451,862 | A | 6/1969 | Burgess, Jr. et al. | |
| 3,521,029 | A * | 7/1970 | Toyooka et al. | 219/201 |
| 3,883,719 | A * | 5/1975 | Hurko | 219/466.1 |
| 3,987,275 | A * | 10/1976 | Hurko | 219/451.1 |
| 4,068,115 | A * | 1/1978 | Mack et al. | 219/386 |
| 4,754,252 | A | 6/1988 | Craig, III | |
| 4,795,499 | A | 1/1989 | Ridenour | |
| 5,140,134 | A * | 8/1992 | Reusche et al. | 219/441 |
| 5,198,638 | A * | 3/1993 | Massacesi | 219/209 |
| 5,276,310 | A * | 1/1994 | Schmidt et al. | 219/521 |
| 5,342,126 | A | 8/1994 | Heston et al. | |
| 5,345,063 | A * | 9/1994 | Reusche et al. | 219/441 |
| 5,508,495 | A * | 4/1996 | Yahav et al. | 219/466.1 |
| 5,952,803 | A | 9/1999 | Canada et al. | |
| 6,037,572 | A * | 3/2000 | Coates et al. | 219/451.1 |
| 6,191,391 | B1 * | 2/2001 | Deo et al. | 219/407 |

(Continued)

FOREIGN PATENT DOCUMENTS

| | | |
|---|---|---|
| GB | 1064927 | 4/1967 |

*Primary Examiner* — Joseph M Pelham

(74) *Attorney, Agent, or Firm* — James E. Howard; Andre Pallapies

(57) ABSTRACT

A household appliance includes a thermostat retainer for supporting a thermostat in an opening in a support plate. The thermostat retainer includes a first body portion having a first width dimension in a direction perpendicular to an axial direction of the first body portion, and a second body portion arranged in series with the first body portion in the axial direction of the thermostat retainer. The second body portion has a second width dimension in the direction perpendicular to the axial direction that is greater than the first width dimension. The first body portion and the second body portion cooperate to form a shoulder that prevents the second body portion from passing through the opening in the support plate. The first body portion or the second body portion includes means for preventing rotation of the thermostat retainer in the opening in the support plate.

20 Claims, 19 Drawing Sheets

(56) References Cited

U.S. PATENT DOCUMENTS

| | | | | |
|---|---|---|---|---|
| 6,222,133 | B1 * | 4/2001 | St. Louis | 219/541 |
| 6,384,380 | B1 * | 5/2002 | Faries et al. | 219/385 |
| 7,009,151 | B2 * | 3/2006 | Lee | 219/460.1 |
| 7,170,035 | B2 * | 1/2007 | Peterson et al. | 219/386 |
| 7,208,700 | B2 * | 4/2007 | Peterson et al. | 219/386 |
| 7,235,762 | B2 * | 6/2007 | Gagas et al. | 219/400 |
| 7,279,659 | B2 * | 10/2007 | Gagas et al. | 219/400 |
| 7,326,885 | B2 * | 2/2008 | Lockwood et al. | 219/443.1 |
| 7,485,176 | B2 | 2/2009 | Bentley et al. | |
| 7,488,919 | B2 * | 2/2009 | Gagas et al. | 219/400 |
| 7,619,182 | B2 * | 11/2009 | Morrow et al. | 219/391 |
| 8,039,729 | B2 | 10/2011 | Nguyen | |
| 2002/0185491 | A1 * | 12/2002 | Danko et al. | 219/536 |
| 2003/0029858 | A1 * | 2/2003 | Gratz et al. | 219/448.17 |
| 2004/0149722 | A1 * | 8/2004 | Schnell et al. | 219/460.1 |
| 2005/0274712 | A1 * | 12/2005 | Gagas et al. | 219/494 |
| 2006/0043087 | A1 * | 3/2006 | Gagas et al. | 219/391 |
| 2006/0049172 | A1 * | 3/2006 | Gagas et al. | 219/521 |
| 2006/0278629 | A1 * | 12/2006 | Gagas et al. | 219/385 |
| 2008/0093353 | A1 * | 4/2008 | Suzuki et al. | 219/548 |
| 2010/0145547 | A1 | 6/2010 | Darabnia et al. | |

* cited by examiner

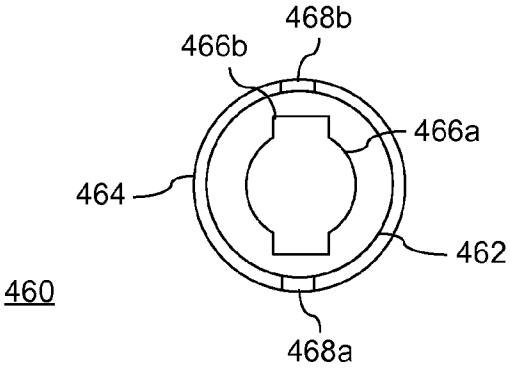
FIG. 13A
FIG. 13B
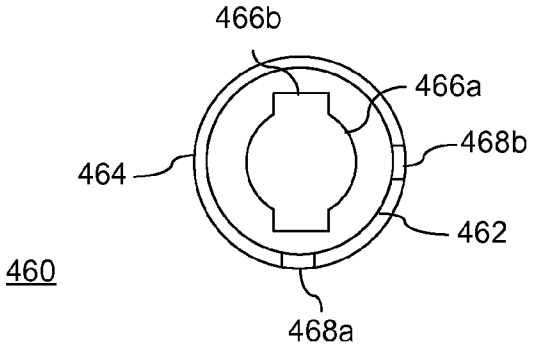
FIG. 13C
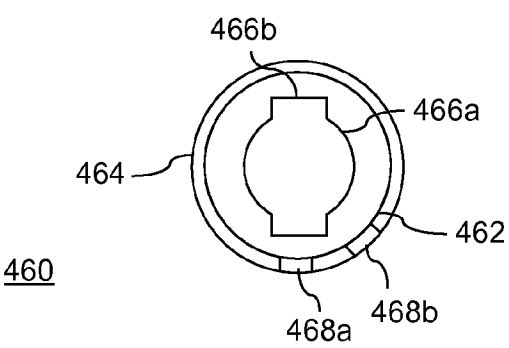
FIG. 13D

HOUSEHOLD APPLIANCE HAVING A THERMOSTAT RETAINER FOR A THERMOSTAT OF A WARMING DRAWER

CROSS-REFERENCES TO RELATED APPLICATIONS

This application is related to Applicants' co-pending U.S. applications, which are filed concurrently herewith, entitled "HOUSEHOLD APPLIANCE HAVING A DEPLOYABLE WARMING DRAWER MODULE", Ser. No. 13/483,095; "HOUSEHOLD APPLIANCE HAVING A WARMING DRAWER WITH A THERMALLY CONDUCTIVE LAYER", Ser. No. 13/483,097; "HOUSEHOLD APPLIANCE HAVING A DRIP GUARD FOR A WARMING DRAWER", Ser. No. 13/483,096; and "HOUSEHOLD APPLIANCE HAVING EMBOSSES SUPPORTING A GLASS HEATING ELEMENT OF A WARMING DRAWER", Ser. No. 13/483,094, each of which is incorporated herein by reference in its entirety.

FIELD OF THE INVENTION

The present invention is directed to a household appliance having a warming drawer, and more particularly, to a household appliance having a thermostat retainer for a thermostat of a warming drawer.

BACKGROUND OF THE INVENTION

Some conventional household appliances may include a warming drawer for warming one or more items P such as food, cookware, cutlery, etc. or maintaining a predetermined temperature of the items. As shown for example in FIG. 1, a conventional warming drawer 1 commonly may include a housing 2 and a drawer 4 having four walls 6, a floor 8, and a handle 10, similar to an ordinary drawer. The drawer 4 may be slidably coupled to the housing 2 by ordinary drawer slides 12 mounted on the interior sidewalls of the housing 2 or to the floor of the housing 2. The functional parts of the warming drawer commonly are attached to the housing 2 of the warming drawer 1. For example, a heating element 14 commonly is fixed to the interior of the housing 2, such as on the floor of the housing 2. In operation, the drawer 4 moves over the heating element 14 when the drawer 4 is in a closed position inside the housing 2 to heat the items P in the drawer 4. The controls (not shown) for the conventional warming drawer commonly are provided on the warming drawer housing 2 or on the housing of the appliance.

SUMMARY OF THE INVENTION

The present invention is directed to a thermostat retainer for supporting a thermostat in manner that improves the thermal contact between the thermostat and a heating element (e.g., a glass/ceramic heating element) to thereby improve the accuracy of the thermostat in detecting a true temperature of the heating element. The thermostat retainer can provide advantages of supporting the thermostat such that a sensing surface of the thermostat is maintained in thermal contact with the underside of the heating element. More particularly, the thermostat retainer can receive and secure the thermostat in the thermostat retainer, prevent the thermostat from passing through the thermostat retainer, and/or prevent the thermostat from rotating with respect to the thermostat retainer. Furthermore, the thermostat retainer can engage an opening in a support plate, prevent the thermostat retainer from passing through the opening of the support plate when installed from above the support plate, prevent the retainer from rotating with respect to the opening of the support plate, and/or accurately position the sensing surface of the thermostat at a predetermined height above the support plate such that the sensing surface thermally contacts the underside of the heating element in an assembled state.

In this way, the thermostat retainer according to the present invention can provide sufficient thermal contact between a thermostat and an underside of the heating element to monitor the true and accurate temperature of the heating element in order to minimize or prevent a risk of the heating element exceeding a predetermined temperature that may result in damage or overheating of the heating element, or to provide a signal to a control unit of the warming drawer for limiting or regulating the temperature of the heating element, such as controlling the operation of the heating element (e.g., On and OFF operation) in order to provide the selected temperature setting. An accurate determination of the true temperature of the heating element may permit a thermostat, control device, or other device to interrupt or disconnect the power supply path to the heating element when a predetermined temperature is reached at the thermostat in time to prevent damage or overheating of the heating element. In other instances, an accurate determination of the true temperature of the heating element may permit a control unit to consistently and accurately heat the heating element to the selected temperature setting from one use to another use. In this way, a user can accurately select an appropriate temperature setting with an expectation that the warming drawer will function and heat the items to be warmed consistently from one use to the next use.

Prior to describing the exemplary embodiments in greater detail, and to provide a better understanding of the invention, this disclosure will first describe some of the problems with conventional warming drawer designs and other background information with respect to the warming drawer designs, along with an explanation of the reasons for improving the arrangement of the warming drawer and the corresponding advantages provided by the present invention.

The conventional warming drawer having a heating element fixed to the interior of the housing and the warming drawer moving over the heating element when the warming drawer is moved to a closed position may have limited or reduced heat transfer between the heating elements and the warming drawer and the contents of the warming drawer and the heat transfer may vary for different positions in the drawer, thereby resulting in hot spots in the drawer. Assembly and repair work for components of such a warming drawer commonly may be difficult to perform particularly where the appliance is installed in cabinetry. The assembly of the parts of the warming drawer within the warming drawer housing during manufacturing also can be complex and time-consuming.

To solve the foregoing problems, a warming drawer has been provided in which functional parts of the warming drawer are assembled together into a sub-assembly or warming drawer module that easily can be inserted and removed from the warming drawer housing by manufacturing personnel, a user, or a repair technician. A heating device may be coupled to and movable with the warming drawer module in and out of the housing. In this way, the warming drawer module can improve heat transfer, and provide more uniform and predictable heat transfer, between the heating element and the contents of the warming drawer module, thereby providing uniform heating at various positions in the drawer and reducing or eliminating hot spots in the warming drawer module. The warming drawer module also can simplify and improve the ease with which assembly and repair work can be performed for components of the warming drawer by enabling the warming drawer module to be removed from the warming drawer housing with a simple connection such that a user or technician can easily and simply perform repairs, replacement, and/or cleaning without having to remove the warming drawer housing. Electrical and control wires and cable, as well as wire and cable routing features, also may be coupled to or included in the deployable warming drawer module so that manufacturing personnel, a user, or a repair technician do not have to route wires or cables when installing and/or removing the warming drawer module.

The heating device of the warming drawer module may be provided by a ceramic/glass heating element that forms a floor surface of the module for receiving the items to be warmed and that provides uniform heat across the entire floor surface of the warming drawer, while also being easy to clean and providing an aesthetically pleasing appearance, for example, when the drawer is deployed form the warming drawer housing. In this case, the underside of the glass commonly has a thin metal layer which, when supplied with an electric current, generates heat evenly across the entire surface of the ceramic/glass heating element. As a result, the entire surface of the ceramic/glass heating element can generate heat and form a portion of an electric circuit. The underside of the ceramic/glass heating element can be supported by support means, such as a plurality of embosses, to minimize or prevent damage to the ceramic/glass heating element from the force (e.g., weight) of the items being exerted on the upper surface of the ceramic/glass heating element. The support means can control a height of the glass/ceramic heating element above a surface of a support plate (i.e., suspend the heating element above the support plate) to provide a predetermined height or clearance for routing wires, such as the wires from the heating element, in the space between the glass/ceramic heating element and the metal support plate.

By controlling the predetermined height or clearance, the support means can provide an area under the glass/ceramic heating element for mounting a thermostat for monitoring a temperature of the heating element. The thermostat can be mounted under the glass/ceramic heating element such that a sensing surface of the thermostat is in thermal contact with the underside of the glass/ceramic heating element to detect a temperature of the heating element and provide control signals, for example, to a control unit for controlling the heating element.

The present invention recognizes that sufficient thermal contact is needed between such a thermostat and an underside of the glass/ceramic heating element in order to monitor the true and accurate temperature of the glass heating element in order to minimize or prevent a risk of the heating element exceeding a predetermined temperature that may result in damage or overheating of the heating element, or to provide a signal to a control unit of the warming drawer for limiting or regulating the temperature of the heating element, such as controlling the operation of the heating element (e.g., On and OFF operation) in order to provide the selected temperature setting. An accurate determination of the true temperature of the heating element may permit a thermostat, control device, or other device to interrupt or disconnect the power supply path to the heating element when a predetermined temperature is reached at the thermostat in time to prevent damage or overheating of the heating element. In other instances, an accurate determination of the true temperature of the heating element may permit a control unit to consistently and accurately heat the heating element to the selected temperature setting from one use to another use. In this way, a user can accurately select an appropriate temperature setting with an expectation that the warming drawer will function and heat the items to be warmed consistently from one use to the next use.

An exemplary embodiment is directed to means for supporting a thermostat in way that improves the thermal contact between the thermostat and the glass/ceramic heating element to thereby improve the accuracy of the thermostat in detecting a true temperature of the heating element. More particularly, a thermostat retainer can be provided that supports the thermostat under the glass/ceramic heating element such that a sensing surface of the thermostat is in thermal contact with the underside of the glass/ceramic heating element. The thermostat retainer can include, for example, one or more means for receiving and securing the thermostat in the retainer, means for preventing the thermostat from passing through the retainer and means for preventing the thermostat from rotating with respect to the retainer, means for engaging the opening in the support plate, means for preventing the retainer from passing through the opening of the support plate when installed from above the support plate, means for preventing the retainer from rotating with respect to the opening of the support plate, means for accurately positioning the sensing surface of the thermostat at a predetermined height above the support plate such that the sensing surface thermally contacts the underside of the glass/ceramic heating element in an assembled state.

In an exemplary embodiment, the thermostat retainer can include a first body portion and a second body portion arranged in series in an axial (longitudinal) direction of the retainer. The second body portion can have a larger width (lateral) dimension in a direction perpendicular to the axial direction than the first body portion. The width dimension of the first body portion can be substantially equal to or less than a dimension of the opening in the support plate to permit the first body portion to extend into the opening when the retainer is inserted into the opening in the support plate from above. Particularly, the width dimension of the first body portion can be substantially equal to the dimension of the opening within a predetermined tolerance that permits the second body portion to fit into the opening with limiting movement in the lateral direction (i.e., direction perpendicular to the axial direction).

The width dimension of the second body portion can be larger than a dimension of the opening in the support plate to prevent second body portion from passing through the opening when the retainer is inserted into the support plate from above, thereby positioning and securing the retainer in the opening of the support plate. In this way, the second body portion extends radially outward from the first body portion to form a shoulder that abuts a surface of the sheet metal of the support plate, thereby limiting an amount that the retainer passes into the opening in the support plate. In other embodiments, the second body portion can have a different shape and/or be larger than the first body portion to prevent the retainer from passing through the opening to the other side of the support plate.

In an exemplary embodiment, the thermostat retainer can include a first cylindrical body portion and a second cylindrical body portion. The first cylindrical body portion and the second cylindrical body portion can be arranged in series in an axial (longitudinal) direction of the retainer. The second cylindrical body portion can have a diameter in a direction perpendicular to the axial direction (lateral direction) that is greater than a diameter of the first cylindrical body portion. The diameter of the first cylindrical body portion can be substantially equal to or less than a diameter of a circular opening in the support plate to permit the first cylindrical body portion to extend into the opening when the retainer is inserted into the opening in the support plate. The diameter of the second cylindrical body portion is larger than a diameter of the circular opening in the support plate to prevent the second cylindrical body portion from passing through the opening when the retainer is inserted into the support plate, thereby positioning and securing the retainer in the opening of the support plate. In this way, the second cylindrical body portion extends radially outward from the first cylindrical portion to form a shoulder that abuts a surface of the sheet metal of the support plate, thereby limiting an amount that the retainer passes into the opening in the support plate. A thickness or height of the second cylindrical body portion in an axial direction can be predetermined to control the desired height of the sensor above the surface of the support plate. In other embodiments, a plurality of retainers having second cylindrical body portions with different heights can be provided such that a technician can select from among the available heights to provide a correct placement of the sensor for a particular assembly or application.

In other exemplary embodiments, the retainer can include one or more protrusions or keys extending from the first cylindrical body portion and/or the second cylindrical body portion such that one or more keys engage one or more corresponding cutouts of an opening in the support plate when the retainer is inserted in the opening. In this way, the cylindrical shaped retainer can be prevented from rotating within the opening about the longitudinal axis of the retainer, which extends in a direction perpendicular to the plane of the support plate. One of ordinary skill will recognize that in other embodiments, the opening can include a key projecting radially inward from the perimeter of the opening and the retainer can include a corresponding cutout extending radially inward into one of the first and second cylindrical body portions.

In another exemplary embodiment, the retainer can include an internal cylindrical bore extending in an axial direction of the retainer that is configured to receive the thermostat when inserted from above. The bore can include, for example, a pair of opposing cutouts or notches that are configured to receive corresponding protrusions or keys on the thermostat. In the example, the existing terminals of the thermostat can function as the keys that engage the notches of the bore. The engagement of the keys (e.g., terminals) in the notches can prevent the thermostat from rotating within the retainer about the longitudinal axis of the thermostat. In other instances in which the thermostat may have a shape other than a cylindrical shape, such as a square or rectangular shape, the internal bore correspondingly can be provided with a square or rectangular internal bore shape.

More particularly, the internal cylindrical bore can include a first bore portion and a second bore portion arranged in series in an axial (longitudinal) direction of the retainer. The first bore portion can have an internal diameter in a direction perpendicular to the axial direction that is greater than a diameter of the second bore portion, thereby forming an internal shoulder for engaging a corresponding shoulder formed by an intersection of a body portion and a sensor of the thermostat. The diameter of the second bore portion can be substantially equal to or greater than a diameter of the cylindrical body of the thermostat to permit the body to extend into the second bore portion when the thermostat is inserted into the bore of the retainer. The diameter of the second bore portion can be less than a diameter of the sensor of the thermostat to prevent the sensor from extending into the second bore portion when the thermostat is inserted into the bore of the retainer.

In an embodiment, the diameter of the first bore portion can be substantially equal to or greater than a diameter of the sensor of the thermostat to permit the sensor to extend at least partially into the first bore portion when the thermostat is inserted into the bore of the retainer. In this way, the retainer can at least partially enclose the thermostat within the bore, thereby protecting the thermostat from damage, etc. A depth from a top of the retainer in the axial direction to the shoulder formed by the intersection of the first bore portion and the second bore portion can be a predetermined distance that is equal to or less than a thickness in the axial direction of the sensor of the thermostat, such that the sensor is flush with the top of the retainer or extends partially above the top of the retainer in an assembled state to permit the sensor to thermally contact the heating element.

In other embodiments, the internal cylindrical bore can have a single bore portion that is greater than or equal to the diameter of the body portion of the thermostat and less than a diameter of the sensor of the thermostat such that the body portion of the thermostat extends into the bore and the sensor rests on top of the retainer without passing into the bore of the retainer.

The retainer can include one or more keys and/or arrangements of keys, each corresponding, for example, to one of the arrangements of the openings having one or more cutouts. The retainer can include any number of keys, such as one, two, three, etc., which can be disposed as a variety of locations around the perimeter of the retainer for engaging corresponding cutouts of the opening to prevent rotation. In other embodiments, for example when more than one type of thermostat and/or retainer is being used, the arrangement of the keys of one more retainers can be different and the corresponding cutouts of one or more openings also can be different, for example, based on a type of thermostat. In this way, one or more of the openings can be configured to correspond only to a particular key arrangement of a particular thermostat retainer, thereby ensuring that each respective thermostat and retainer can only be installed in a single, correct location on the support plate, which may simplify the manufacturing process.

In other embodiments, one or more portions of the retainer (e.g., the first portion and/or the second portion) can have other perimeter shapes, for example, that can limit or prevent rotation of the retainer in the opening by virtue of their shape and without a key on the retainer or a cutout on the opening of the support plate. For example, the retainer and the opening can have corresponding perimeter shapes that are oval, rectangular, square, hexagonal, etc. that will prevent the retainer from rotating in the correspondingly-shaped opening, thereby fixing the position of the thermostat with respect to the opening of the support plate without additional corresponding key and/or cutout features formed on the thermostat retainer and/or the opening.

The thermostat retainer can be formed from a material that is resistant to temperature and/or electrically insulating. For example, the retainer can be formed from a UL approved flame-rated temperature resistant resin having electrical insulation properties. In this way, the retainer can insulate the thermostat from the metal support plate. In this way, the exemplary embodiments can provide a thermostat retainer that can support limiting/regulating thermostats in a position against, or in thermal contact with, a heated surface of the glass heating element without creating an electrical path to ground.

The exemplary embodiments can be configured to take advantage of an existing shape of conventional thermostats (i.e., off-the-shelf part) to provide an electrically insulated fixation, that can simultaneously ensure that sufficient access is available for accessing a reset button, for example, on a manually resettable thermostat.

The exemplary embodiments can provide a fixation or retainer that can hold the outside diameter of the thermostats and can engage the existing terminals of the thermostat to prevent rotation of the thermostat with respect to the support surface, for example, by providing one or more key cutouts that engage the existing terminals of the thermostat. The exemplary embodiments can position the sensing surface of the thermostat to be disposed slightly higher than a top surface of the thermostat retainer to ensure thermal contact of the sensor with the underside of the glass heating element. The exemplary embodiments can position the sensing surface of the thermostat at a predetermined height above a surface of the support plate, thereby providing or controlling the minimum electrical clearances required by agency. The exemplary embodiments of the retainer can be formed of a UL approved flame-rated temperature resistant resin with good electrical insulation properties, thereby providing an electrically insulating retainer that is easy to assemble (i.e., no screws or fasteners required). The exemplary embodiments of the retainer can prevent rotation of the thermostat with respect to the support plate, and thus, with respect to the glass heating element. The exemplary embodiments of the retainer can allow a user to reset a manual reset button on the thermostat without having to remove the thermostat. The exemplary embodiments of the retainer can ensure that agency required spacing or clearances for the electrical terminals of the thermostat can be achieved.

Moreover, the exemplary embodiments of the retainer can improve the thermal conductivity between the thermostat and an underside of the glass/ceramic heating element and ensure that a temperature limiting and regulating thermostat provides an accurate determination of the true temperature of the heating element, to thereby permit the control unit to consistently and accurately heat the heating element to the selected temperature setting from one use to another use, and to minimize or prevent the risk of the heating element exceeding a predetermined temperature that may result in damage or overheating of the heating element. In this way, the thermostat can provide accurate information of the true temperature of the heating element such that the control unit can shut down the heating element, if needed, prior to an occurrence of damage to, or overheating of, the heating element or the warming drawer, or adjacent components of the appliance.

In the exemplary embodiments, a household appliance can include a warming drawer with a fixed warming drawer module and glass heating element or a warming drawer module having a glass heating element that is movable in and out of a warming drawer housing.

Other features and advantages of the present invention will become apparent to those skilled in the art upon review of the following detailed description and drawings.

BRIEF DESCRIPTION OF THE DRAWING

These and other aspects and features of embodiments of the present invention will be better understood after a reading of the following detailed description, together with the attached drawings, wherein:

FIGS. 13A-13D are bottom, plan views of a thermostat retainer according to exemplary embodiments of the invention.

DETAILED DESCRIPTION OF THE EXEMPLARY EMBODIMENTS OF THE INVENTION

Figure 1:
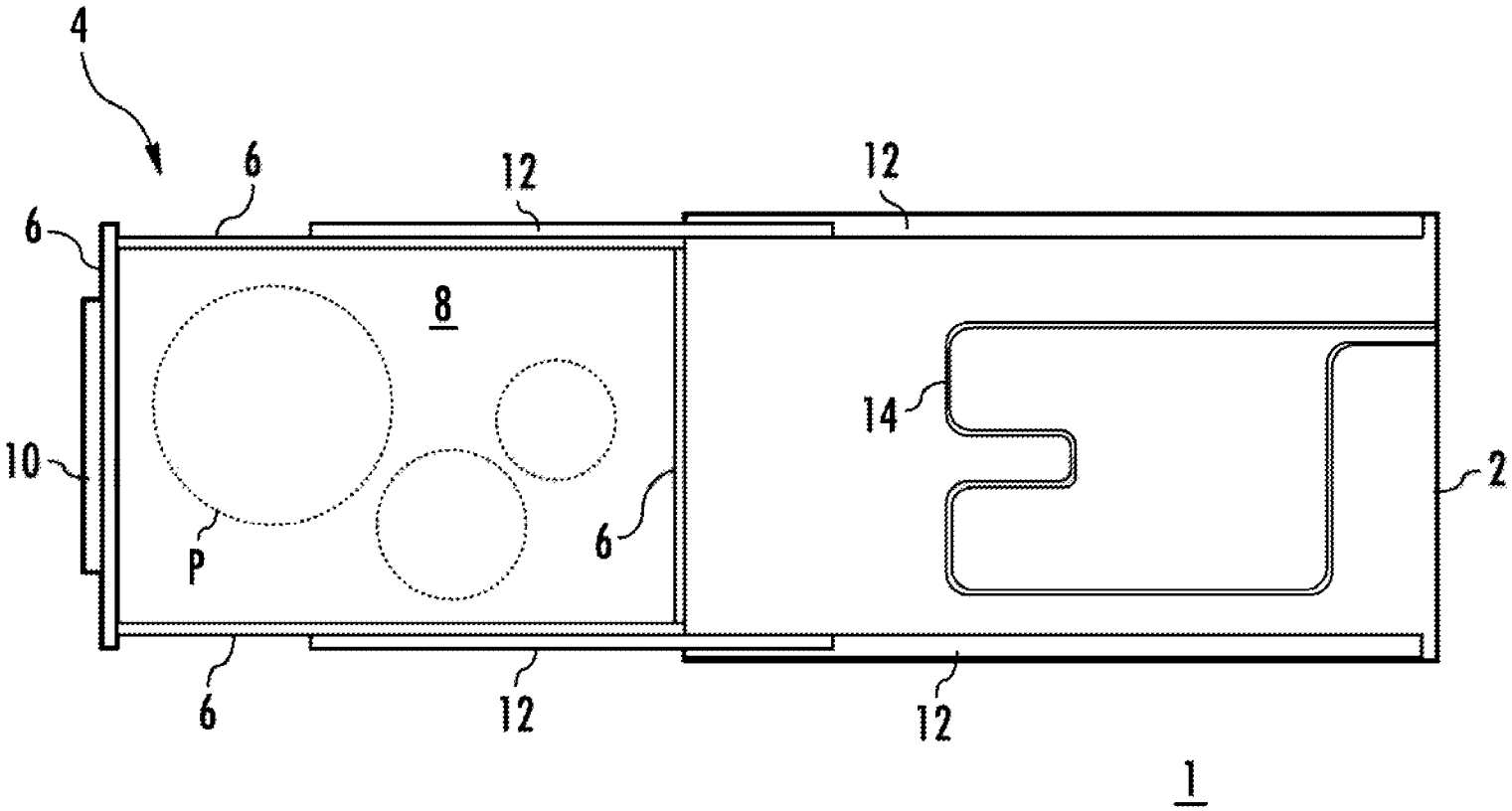
FIG. 1 PRIOR ART
FIG. 1 is a plan view of a conventional household appliance having a warming drawer.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 2-16C illustrate exemplary embodiments of a household appliance having a thermostat retainer for a thermostat of a warming drawer. Prior to describing the exemplary embodiments of the thermostat retainer in greater detail, and to provide a better understanding of the invention, this disclosure will first describe an exemplary warming drawer assembly that derives particular advantages from the thermostat retainer according to the present invention.

Figure 2:
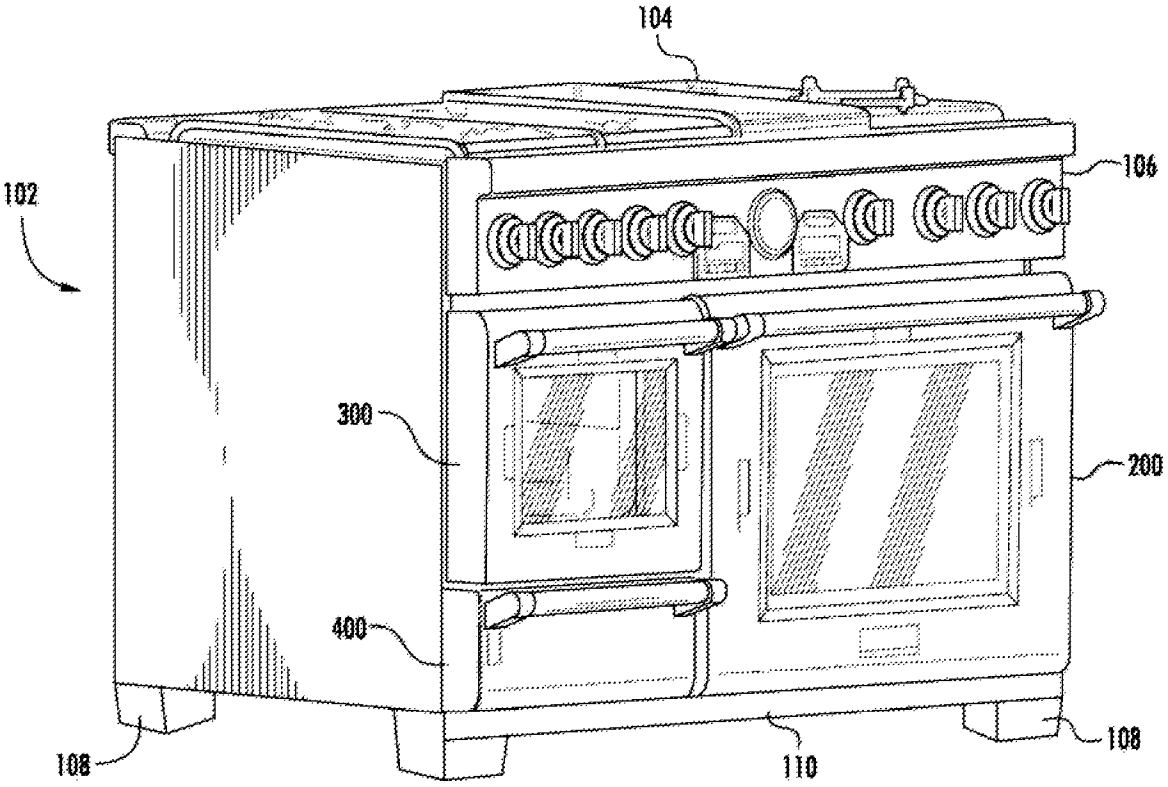
FIG. 2 is a perspective view of a household appliance according to an exemplary embodiment of the invention.

With reference to FIG. 2, an exemplary household appliance 100 can include a cooking range having a housing 102 including one or more cooking or warming devices, such as a cooktop, gas oven, electric oven, steam oven, convection oven, and/or warming drawer. In other embodiments, the appliance 100 can include one or more oven cooking chambers without a cooktop. In other embodiments, the appliance 100 can include a standalone appliance, wall mounted appliance, or countertop appliance, such as a stand-alone warming drawer, wall mounted warming drawer, or countertop warming drawer. The appliance housing 102 can include, for example, a cooktop 104 and control panel 106. The cooktop 104 can include, for example, a gas cooktop having a plurality of gas burners, or other types of cooktops, such as an electric cooktop, an induction cooktop, or the like. The exemplary household appliance 100 can include one or more doors, such as a baking oven door 200, a steam oven door 300, and/or a warming drawer door 400 for providing access to one or more chambers of the housing 102. The housing 102 can include pedestal feet 108 for example for supporting the stand alone appliance and a kick panel 110.

Figure 3:
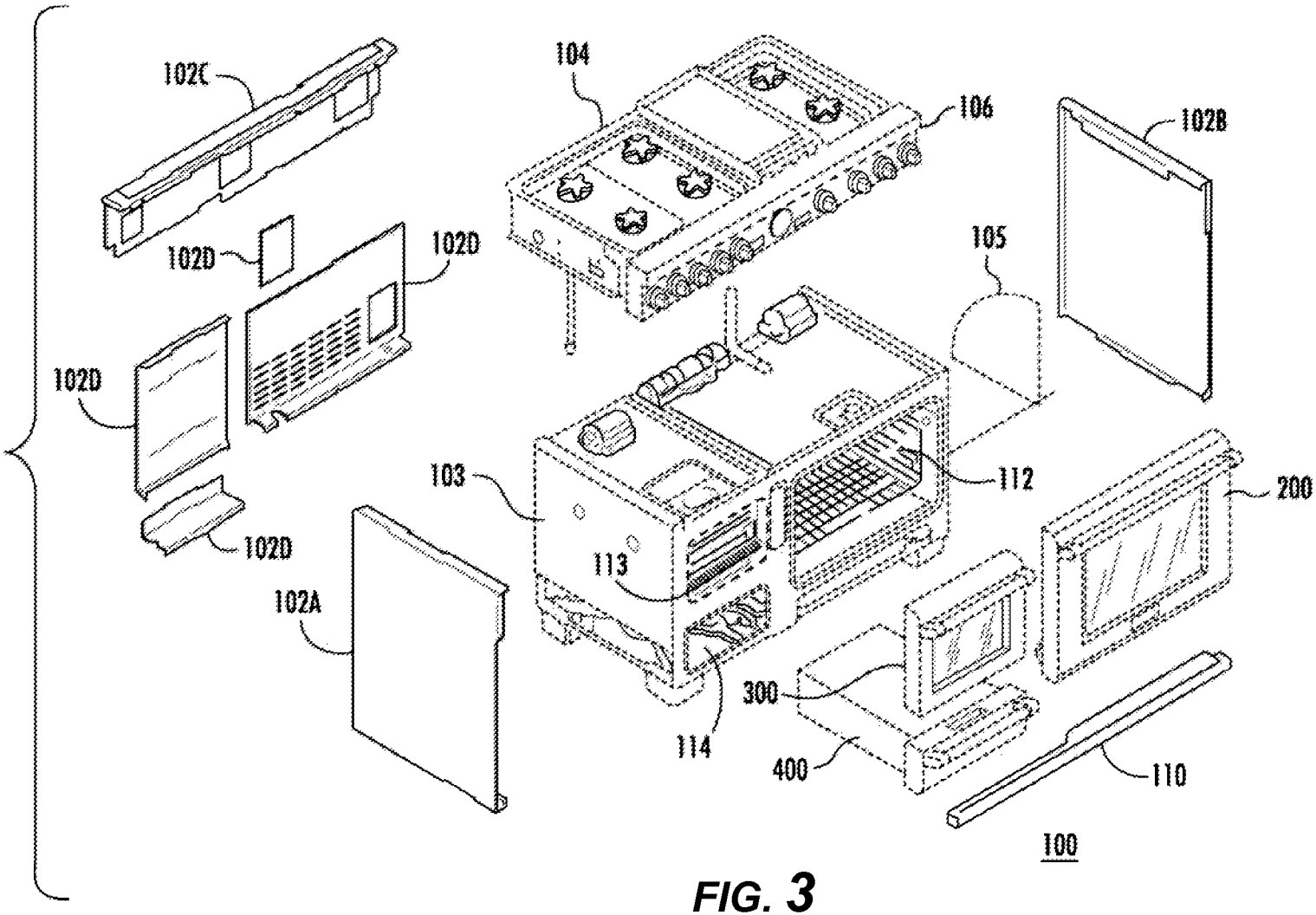
FIG. 3 is an exploded view of a household appliance according to an exemplary embodiment of the invention.

Referring to FIG. 3, the housing 102 of the exemplary household appliance 100 shown in FIG. 2 further can include, for example, left-hand and right-hand sidewalls 102A, 102B and one or more rear panels 102D on a frame 103. The exemplary appliance 100 can include other devices and features, such as, for example, a backsplash 102C, hideaway label plate 105, etc. The frame 103 can include one or more chambers for cooking or warming devices, such as a baking oven chamber 112, steam oven chamber 113, and/or warming drawer chamber 114.

Figure 4:
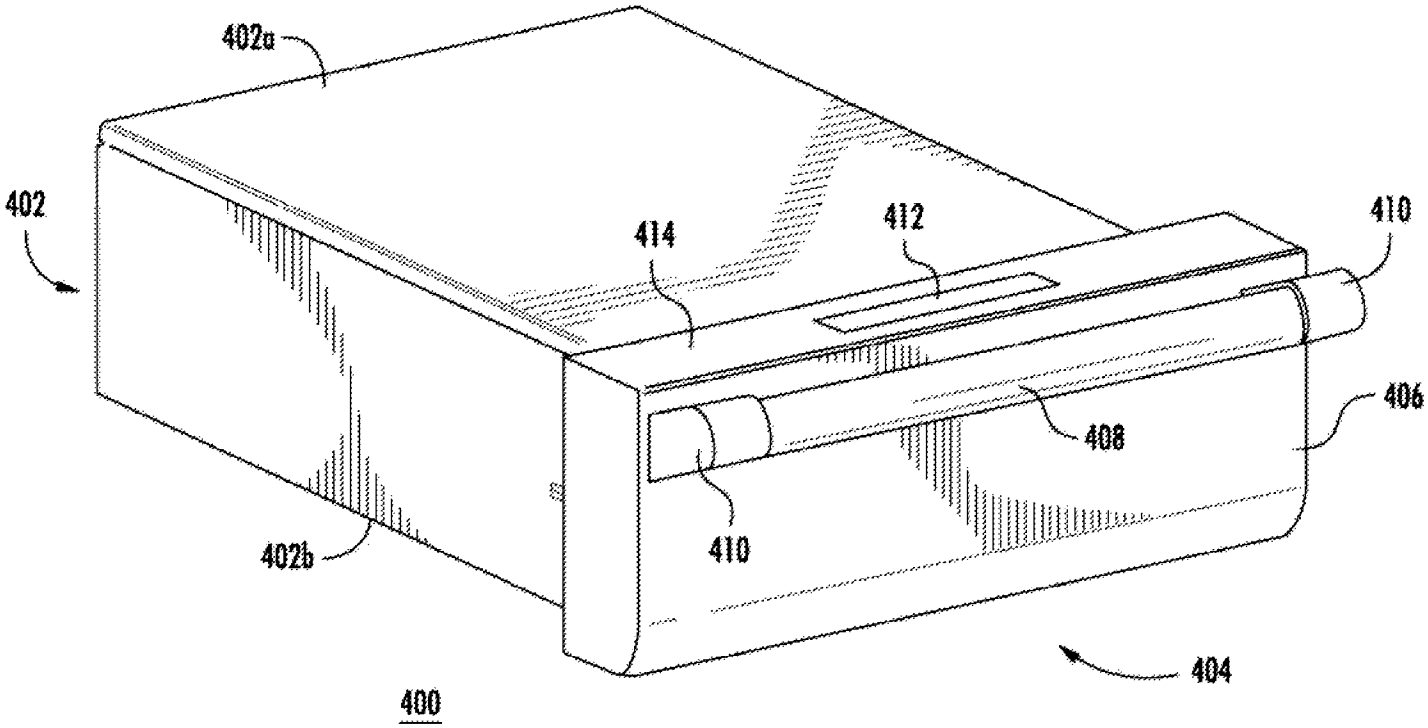
FIG. 4 is a perspective view of a warming drawer according to an exemplary embodiment of the invention.

With reference to FIG. 4, an exemplary embodiment of a modular warming drawer 400 will now be described in which the functional components of the warming drawer are deployable from within a fixed warming drawer housing.

Figure 6:
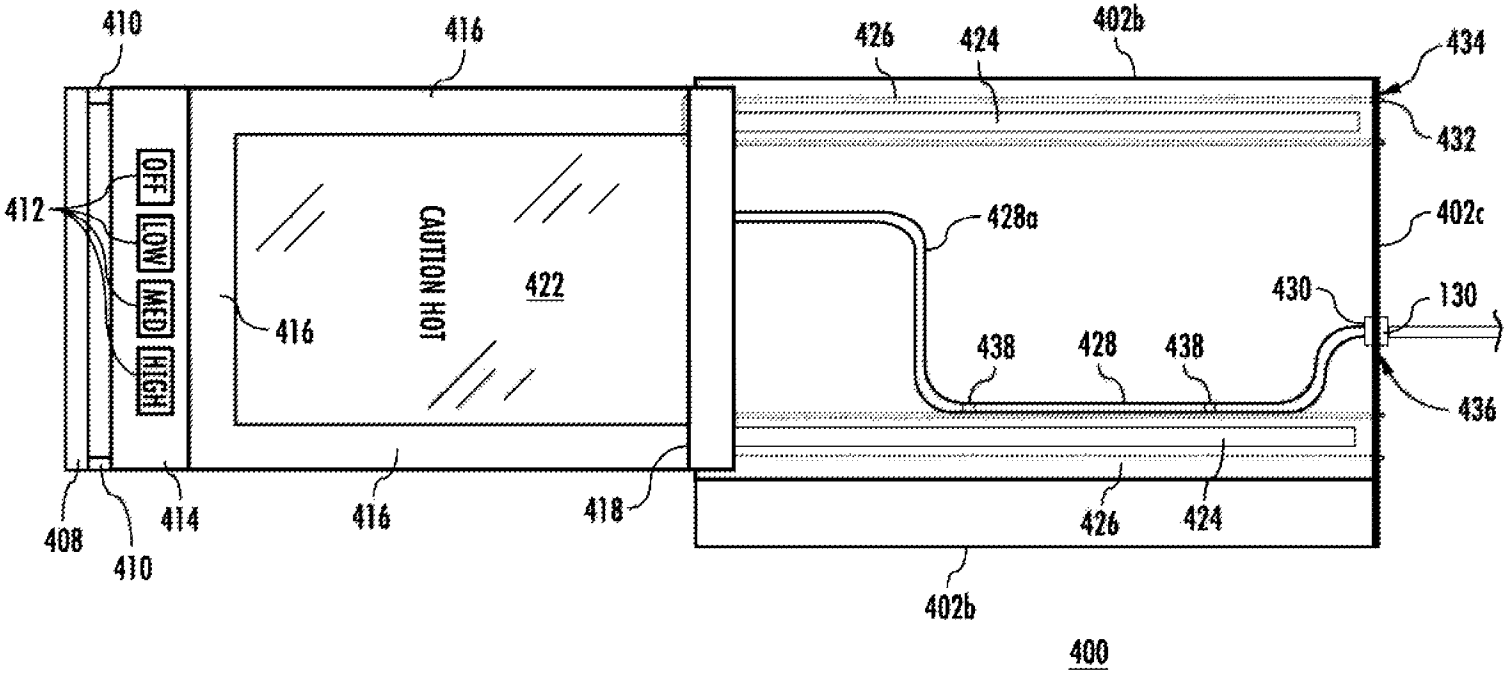
FIG. 6 is a plan view of a warming drawer having a deployed warming drawer module according to an exemplary embodiment of the invention.

The modular warming drawer 400 can include, for example, a fixed warming drawer housing 402 having a top 402*a*, a bottom (not visible in FIG. 4), sidewalls 402*b*, and a rear wall (not visible in FIG. 4). The top, bottom, sidewalls, and/or rear wall of the warming drawer housing 402 can be, for example, stainless steel panels. The warming drawer housing 402 can be disposed in the warming drawer chamber 114 shown in FIG. 3. The modular warming drawer 400 can include, for example, a deployable warming drawer module 404 having a front panel 406, a handle 408 coupled to the front panel 406 via, for example, handle mounts 410. The front panel 406 and other portions thereof can include, for example, one or more stainless steel panels. The deployable warming drawer module 404 can include, for example, a control panel 412 for controlling the functions of the warming drawer module 404. The control panel 412 can be, for example, a concealed control panel on or recessed within the upper surface 414 of the front panel 406, which is visible to a user only when the warming drawer module 404 is in a deployed position, as illustrated in FIG. 6 described in greater detail below. In other embodiments, the control panel 412 can be on or recessed within the face of the front panel 406 or a side of the front panel 406. The control panel 412 can include, for example, one or more touch-activated switches for controlling an operation of the warming drawer 400, such as, for example, an 'OFF' setting, a 'LOW' setting, a 'MED' setting, and a 'HIGH' setting.

Figure 5:
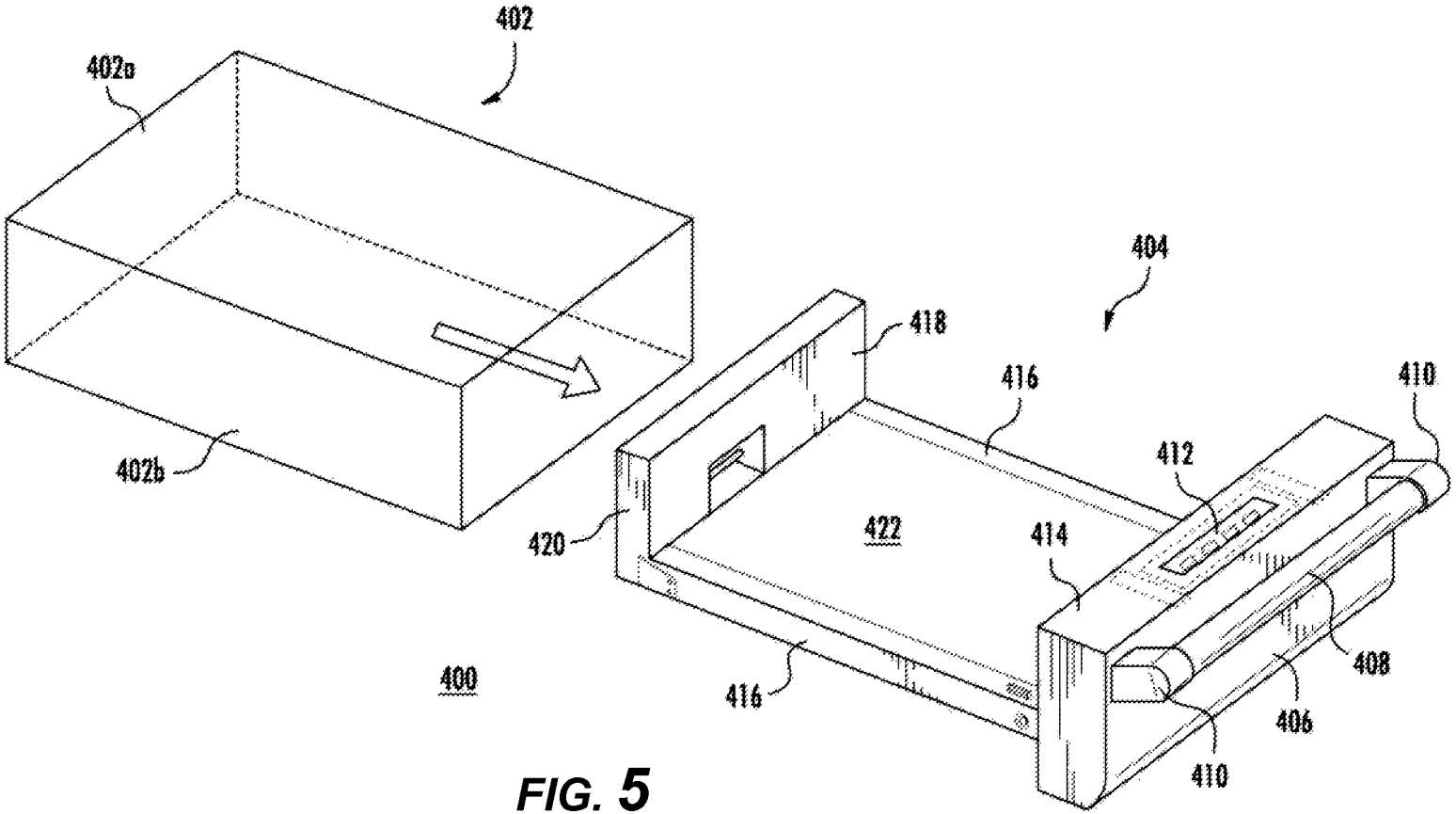
FIG. 5 is a partially exploded perspective view of a warming drawer according to an exemplary embodiment of the invention.

With reference to FIGS. 5 and 6, the exemplary warming drawer module 404 can include a frame 416 coupled to the front panel 406, and a rear panel 418 coupled to an opposite end of the frame 416, for example, via a bracket portion 420 (which may be formed separately or integrally with the rear panel 418). The exemplary warming drawer module 404 can include a heating device, such as a sheet glass or glass/ceramic heating element 422, which is disposed in or supported by the frame 416. The sheet glass or glass/ceramic heating element 422 can form a floor surface of the warming drawer module 404, such as a warming surface for supporting (e.g., directly supporting) items to be warmed. The heating element 422 can be supplied with power from a power source and controlled by the control panel 412 to selectively provide one or more predetermined temperatures for the warming area in the warming drawer module or the floor surface of the warming drawer module. An exemplary embodiment of a heating element is described in greater detail with reference to FIG. 8. The warming drawer module 404 can be, for example, slidably deployable from within the warming drawer housing 402 using various arrangements of various types of drawer slides.

With reference again to FIGS. 5 and 6, the warming drawer module can be configured without sidewalls (e.g., without a left-hand sidewall or right-hand sidewall) connecting the front panel 406 to the rear panel 418, thereby improving and simplifying a user's access to the warming area, and particularly to the heating element 422, for example, for loading and unloading plates, cookware, cutlery, and/or food into and out of the warming drawer module 404. In other embodiments, the warming drawer can include a left-hand sidewall or a right-hand sidewall connecting at least one side of the front panel 406 to the rear panel 418. In still other embodiments, the warming drawer can include a left-hand sidewall and a right-hand sidewall connecting both sides of the front panel 406 to the rear panel 418. In another embodiment, the warming drawer module 404 can include only the front panel 406 without a left-hand sidewall, right-hand sidewall, or rear panel 418. The frame 416 and optional rear panel 418 and/or side panels can be, for example, stainless steel panels.

As shown in FIGS. 5 and 6, the exemplary warming drawer module 404 can be movable in a direction (shown by an arrow in the exploded view of FIG. 5) from a first position (e.g., a stored position as shown in FIG. 4) within the warming drawer housing 402 to a second position, such as a deployed position (e.g., as shown in FIG. 6) that is at least partially outside of the warming drawer housing 402 and that permits access to an interior of the warming drawer module 404 (e.g., access to the glass/ceramic heating element 422) or access to concealed controls (if equipped)(e.g., 412) of the warming drawer module 404, as exemplarily illustrated in FIGS. 5 and 6. The deployed position can include various partially or fully deployed positions of the warming drawer module 404 with respect to the warming drawer housing 402 and is not limited to the illustrated positions in the Figures.

As shown in FIGS. 5 and 6, the exemplary warming drawer module 404 can include one or more functional components (e.g., heating element 422, electrical wires 428, and/or control components 412) of the warming drawer 400 such that one or more of these functional components move with the warming drawer module 404 between the first position and the second position. The controls of the warming drawer 400 can be disposed on (i.e., on-board) the warming drawer module 404 such that the controls 412 are accessible when the warming drawer module 404 is in a deployed position and concealed by the appliance housing or another door on the appliance housing when the warming drawer 400 is in the first (i.e., closed) position. In other embodiments, the controls can be electrically connected to the warming drawer module 404 but remotely located from the warming drawer module 404, such as on the warming drawer housing 402, the housing (102 in FIG. 2) of the appliance 100, the control panel (106 in FIG. 2) of the appliance 100, etc.

The exemplary warming drawer module 404 can be movable further in the direction shown in FIG. 5 from the first position to a third position in which the warming drawer module 404 is removed completely from the warming drawer housing 402, such that the functional components (e.g., all of the functional components) of the warming drawer 400 are accessible to a user or a repair technician.

With reference to FIG. 6, an exemplary warming drawer module 404 is illustrated in a deployed position (e.g., a fully deployed position). The warming drawer module 404 can include one or more slides 424 for facilitating movement of the warming drawer module 404 (including the functional components, such as the heating element 422) between the stored position in the warming drawer housing 402 and the deployed position outside of the warming drawer housing 402. The slides 424 can be coupled, for example, directly to a part of the warming drawer housing 402, such as the floor for the warming drawer housing 402. The warming drawer module 404 optionally can include means for increasing the rigidity and stiffness and reducing deflection of the warming drawer module 404, such as one or more channels or supports 426 (shown with dashed lines)(e.g., channels or supports having a U-shaped, I-shaped, T-shaped, L-shaped, square-shaped, rectangular-shaped, circular-shaped, or oval-shaped cross-section) to increase the rigidity of the warming drawer module 404, stiffen the slide mounting, reduce deflection of a part of the warming drawer housing 402 or the warming drawer module 404, etc., particularly when the warming drawer module 404 is in a deployed position and/or in a loaded position. A drawer slide 424 can be coupled to the frame 416 of the warming drawer module and to the channels 426, which in turn can be coupled to the warming drawer housing 402 at one or more locations (e.g., floor, sidewall, rear wall, and/or frame of the warming drawer housing 402). In this way, the warming drawer module 404 can be coupled to the warming drawer housing 402 via one or more channels 426.

As shown in FIG. 6, a channel 426 can include one or more locking features or means for securing the channel 426 to the warming drawer housing 402, for example, one or more protrusions 432 on an end of the channel that engage an opening 434 in a rear panel 402*c* of the warming drawer housing 402. The locking feature or means can include one of more openings (not shown) formed in a portion of a front end of the channel 426 for receiving a fastening device and securing the front end of the channel 426, or another portion of the channel 426, to a part of the warming drawer housing 402 that can be easily accessed by a user or technician from a front area of the warming drawer 400 without removing the warming drawer module 404 or warming drawer housing 402.

The warming drawer module 404 can include a cable harness 428 for guiding one or more electrical wires or cables and/or data wires or cables to one or more components or parts of the warming drawer module 404, or one or more individual or bundled wires and/or cables. One or more of the wires or cables can include an electrical connection 430 that is electrically coupled to an electrical connection 130 of the household appliance 100, such as an electrical connection to a power supply connection, data connection, or control connection of the household appliance 100. The electrical connection 130 can be mounted in an opening 436 in the rear panel 402*c* of the warming drawer housing 402, as shown in FIG. 6. The warming drawer module 404 also can include cable routing or management devices such that users or repair technicians do not need to route wires or cables when installing and/or removing/repairing the functional parts of the warming drawer module 404. For example, the cable harness 428 can be coupled to one or more of the channels 426 at one or more locations using one or more coupling devices 438 (e.g., cable ties, clamps, or the like) to prevent snagging or kinking of the cable harness 428 and/or wires/cables during movement of the warming drawer module 404 in and out of the warming drawer housing 402. The cable harness 428 can be provided with a freely bendable and movable portion 428*a* having sufficient length (e.g., slack) to permit the moveable portion of the warming drawer module 404 to move in and out of the warming drawer housing 402 between the stored position and the deployed position without disconnecting the electrical, data, or power supply connection (e.g., 430) of the warming drawer module 404 from the corresponding electrical connection 130 of the warming drawer housing 402.

As shown in FIG. 6, many or all of the functional components of the warming drawer 400, such as the glass/ceramic heater element 422 and controls 412, can be on the movable portion of the warming drawer module 404 such that the functional components move with the movable portion of the warming drawer module 404 in and out of the warming drawer housing 402.

Figure 7:
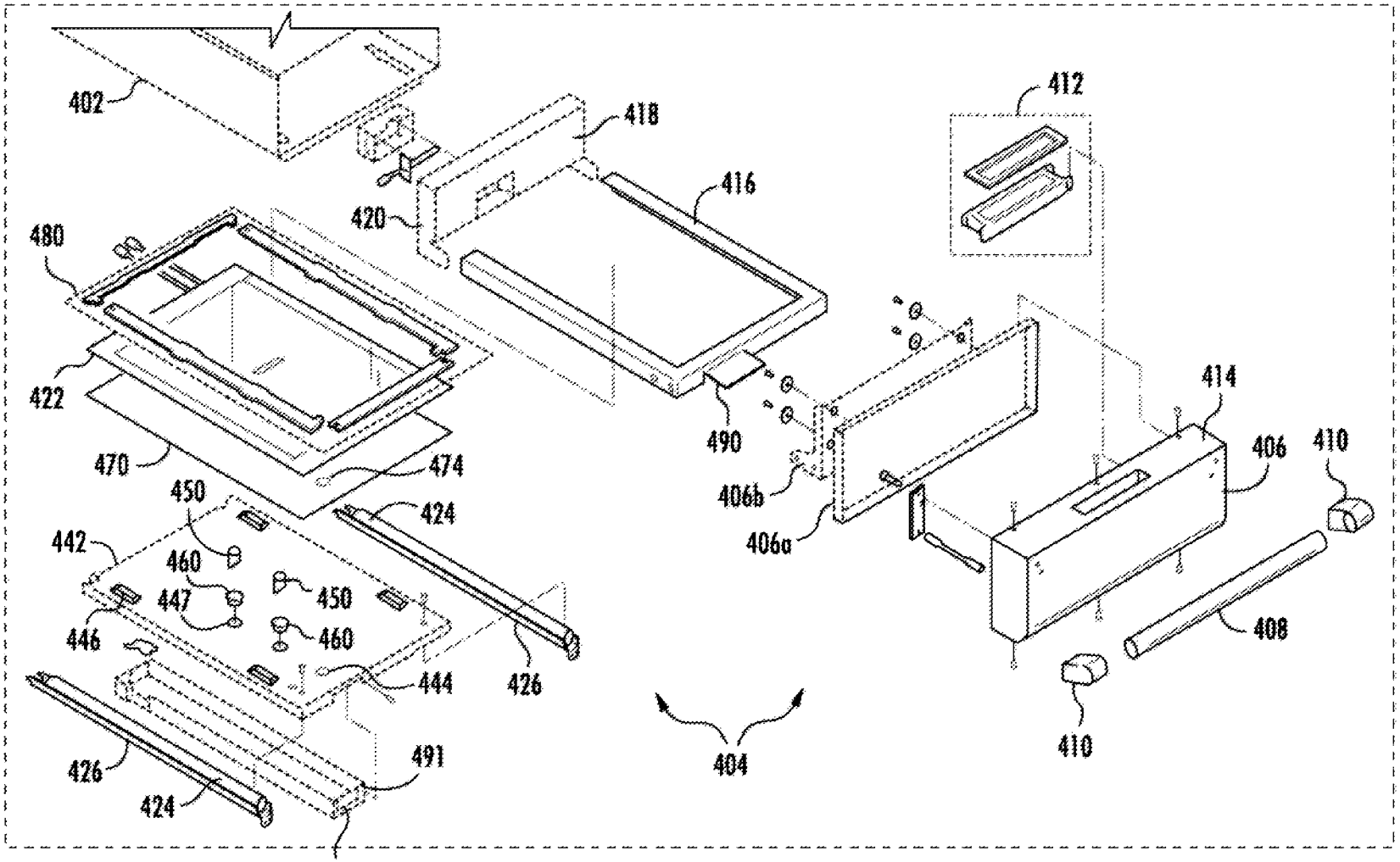
FIG. 7 is an exploded, perspective view of a warming drawer according to an exemplary embodiment of the invention.

With reference to FIG. 7, an exemplary embodiment of a warming drawer 400 will now be described in greater detail.

The exemplary warming drawer 400 can include, for example, a warming drawer housing 402 and a warming drawer module 404, shown in an exploded view. The warming drawer module 404 can include a front panel 406 having a handle 408 coupled to the front panel 406 via handle mounts 410. The front panel 406 can include a control panel 412 disposed in an opening or recess in an upper surface 414 of the front panel 406. The front panel 406 can include a rear portion 406*a* that encloses a rear side of the front panel 406 and a bracket 406*b* for coupling the rear portion 406*a* to a front portion of a frame 416 of the warming drawer module 404. A rear portion of the frame 416 can be coupled to a rear panel 418 via bracket portions 420 (which may be formed separately or integrally with the rear panel 418).

As explained above, the warming drawer 400 can include a heating device assembly including a ceramic/glass heating element 422, which is described in greater detail with reference to FIG. 8. The ceramic/glass heating element 422 forms the floor of the warming drawer module 404, and thus, will be directly loaded with plates, cookware, cutlery, food, etc. To support an underside of the ceramic/glass heating element 422, a support plate 442 (e.g., stainless steel support plate) can be provided to support the glass heating element 422. The support plate 442 can include one or more supporting features, such as a plurality of embosses 446, for supporting the glass heating element 422 a predetermined distance above the support plate 442 and minimizing thermal and electrical contact areas between the heating element 422 and the support plate 442. Exemplary embodiments of a support plate having embosses is described in greater detail with reference to FIG. 9A. The support plate 442 also can include one or more openings 447 for receiving one or more thermostat retainers 460 that support and fix one or more thermostats 450 in a predetermined position and height above the surface of the support plate 442 and against the underside of the glass heating element 422.

A thermally conductive sheet 470 having low thermal resistance and high electrical resistance qualities can be disposed over the entire support plate 442, or at least the contact points between the plurality of embosses 446 and the thermostats 450 and the conductive underside of the glass heating element 422. In other embodiments, individual portions of thermally conductive tape (not shown) can be provided locally at each location of the embosses 446 and/or thermostats 450. The thermally conductive sheet 470 or thermally conductive tape can include, for example, UL (Underwriter Laboratories) listed silicone electrically insulating material. The glass heating element 422 can be disposed directly on the thermally conductive sheet 470 and supported by the plurality of embosses 446 under the sheet 470.

An upper edge or perimeter surface of the glass heating element 422 can be covered by one or more gasket strips 480 for spills or liquids. The frame 416 can be disposed over the gasket strips 480 and the glass heating element 422, and then secured to the support plate 442, thereby keeping spills or other liquids away from electrical components in the module 404. The rear panel 418 may be disposed over a rear strip of the gasket strips 480. In this way, the glass heating element 422 can form both a floor surface of the warming drawer module 404 and the heating surface of the warming drawer module 404, thereby providing uniform heating of the items in the warming drawer module 404, and such that the items to be warmed can be placed directly on the glass heating element 422 when the warming drawer 404 is deployed.

As shown in FIG. 7, the support plate 442 can include a wire guide 491 coupled to an underside of the support plate 442 for guiding one or more wires or cables from for example the thermostats 450, the heating element 422, or other electrical components to the interior of the front panel 406 and the control panel 412. The support plate 442 and the thermally conductive sheet 470 can include corresponding openings to permit the electrical leads from the glass heating element 422 to pass through the support plate 442 and the thermally conductive sheet 470 to the wire guide 491. The frame 416 optionally can include a drip guard 490 to protect an electrical connection from spills. For example, the drip guard 490 can guide spills, cleaning solutions, etc. from the upper surface of the glass heating element 422 and the frame 416 away from and around a first electrical connector (such as a first wiring harness connector) on the support plate 442, which may be disposed at an end of the wire guide 491, and a second electrical connector (such as a second wiring harness connector) in the front panel 406 that leads to the control panel 412, and/or away from the electrical components above or below the support plate 442 or on the glass heating element 422.

As explained above, the warming drawer module 404 and the functional components are movable in and out of the warming drawer housing 402. In the embodiment of FIG. 7, a pair of slides 424 can be coupled to the support plate 442, and particularly, for example, to the underside of the support plate 442. The channel 426 can be coupled to the slides 424 to complete the warming drawer module 404. One of ordinary skill will recognize that the warming drawer module 404 is not limited to particular features and arrangement shown in FIG. 7 and additional or alternative parts, components, and arrangements may be included in the warming drawer module 404 within the spirit and scope of the invention.

Figure 8:
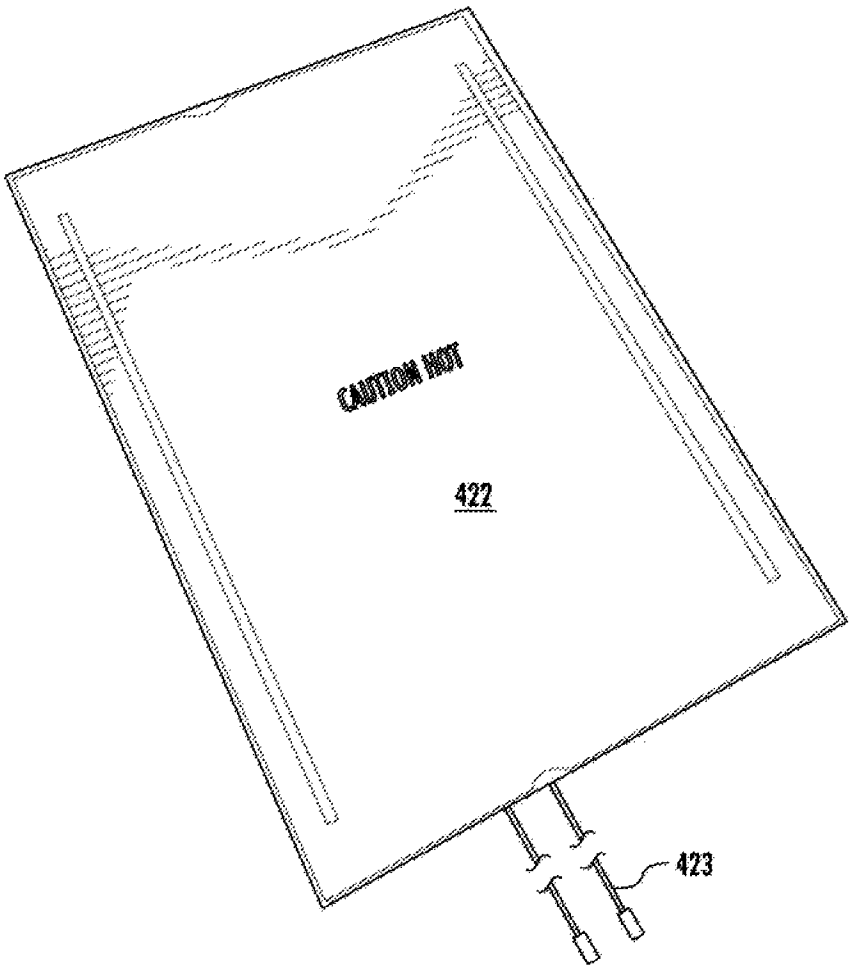
FIG. 8 is a perspective view of a heater device according to an exemplary embodiment of the invention.

With reference to FIG. 8, an exemplary heating device for a warming drawer module will now be described.

An exemplary heating device can include, for example, a ceramic/glass heating element 422 forming a floor surface of the warming drawer module for supporting the items to be warmed, such as food, plates, cookware, cutlery, etc. The heating element 422 can be a resistance heating element, for example, that operates similar to a rear window defroster of an automobile. The glass heating element 422 can include a glass ceramic surface having a plurality of heating element conducting paths or a uniform conductive coating (e.g., a clear, even conductive coating), for example, a 780 W element, thereby providing quick and even heating of items in the warming drawer module. More particularly, the underside of the ceramic/glass heating element 422 can include a thin metal layer that can generate heat evenly across the entire surface when provided with an electric current supplied, for example, by one or more power supply lines/wires/connectors 423. In the example, the entire surface can form a portion of an electric circuit such that the entire surface of glass/ceramic heating element 422 can generate heat (e.g., evenly generate heat). The ceramic/glass heating element 422 can provide uniform heat across an entire floor surface of the warming drawer module 404. The glass heating element can be easily cleaned, thereby reducing cleaning time and effort by the user for cleaning up spills, etc. from the floor surface of the warming drawer. The glass heating element 422 may include other features, such as a hot surface indicator (e.g., active indicator) for notifying a user or technician when the heating surface is hot, a passive warning for example painted on the glass surface, or an automatic shut-off timer to avoid overheating of the glass heating element 422 or reduce energy consumption in the event a user inadvertently fails to turn off the warming drawer, among other things.

Figures 9A, 9B, 9C:
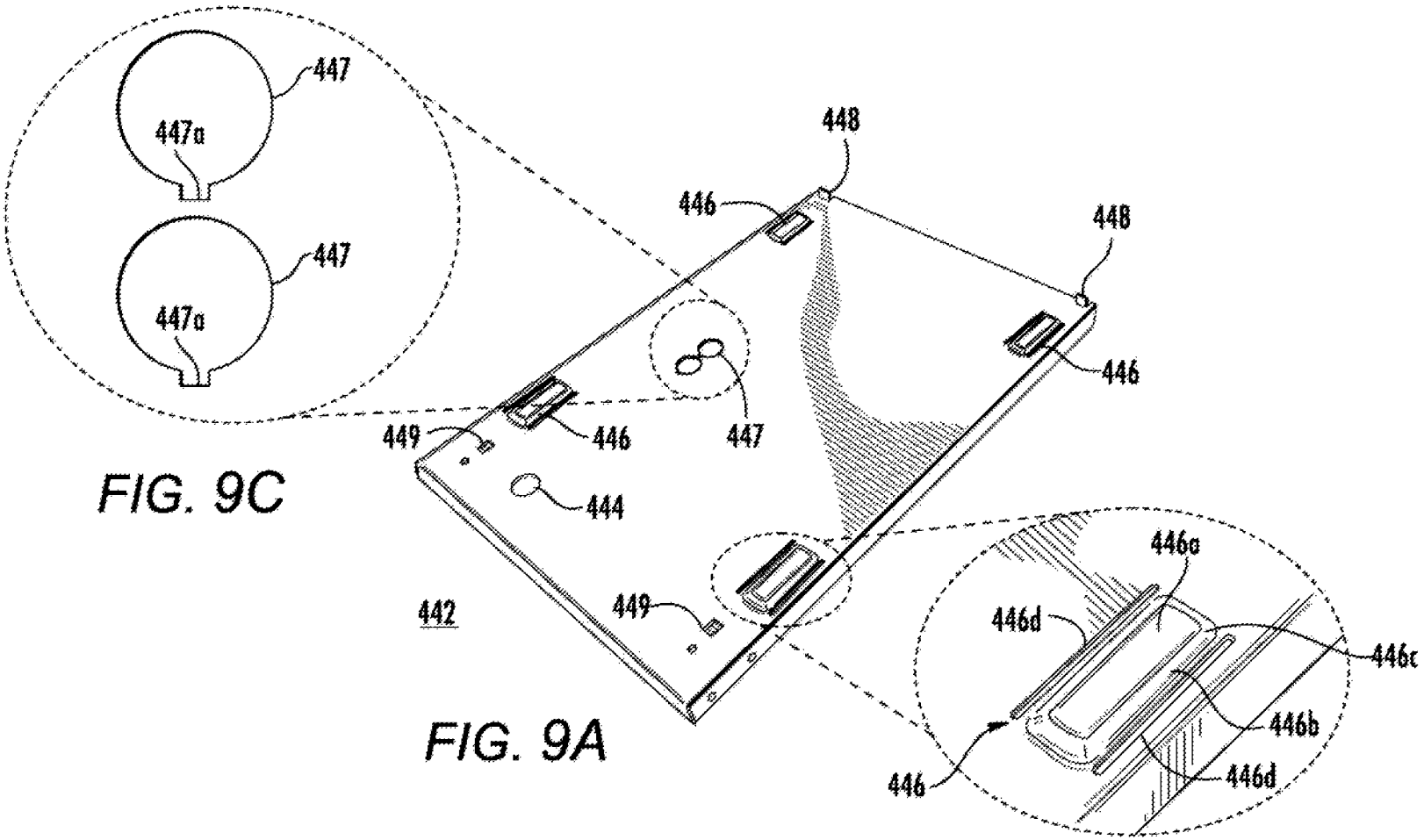
FIG. 9A is a perspective view of a support plate according to an exemplary embodiment of the invention.
FIG. 9B is an enlargement of a portion of the support plate in FIG. 9A.
FIG. 9C is an enlargement of openings in the support plate in FIG. 9A.
Figure 9G:
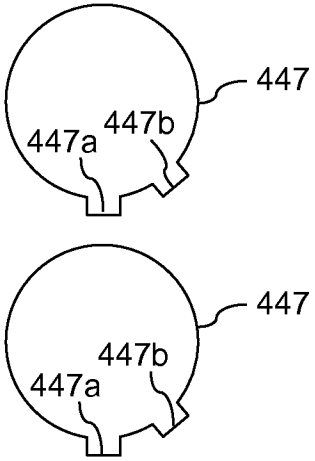
FIGS. 9D, 9E, 9F and 9G are plan views illustrating examples of openings in the support plate having a plurality of key cutouts formed in a perimeter of the opening according to exemplary embodiments of the invention.
Figure 9F:
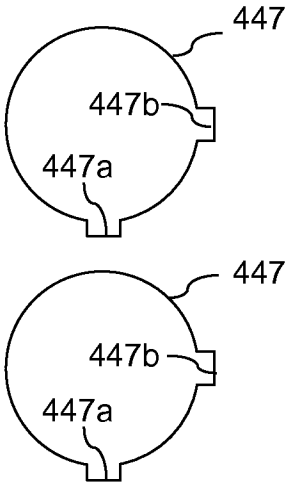
Figure 9E:
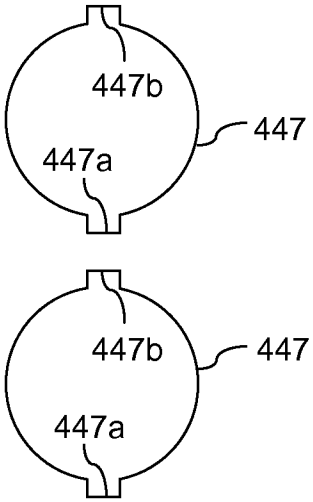
Figure 9D:
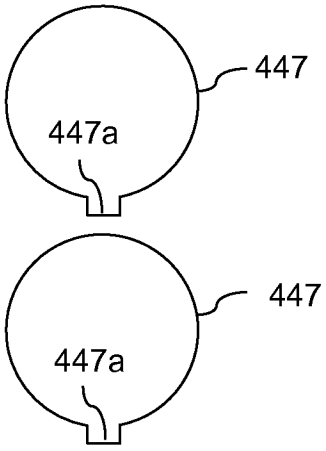

With reference to FIG. 9A, exemplary embodiments of a support plate 442, which can support a glass/ceramic heating element 422 of the warming drawer module 404 (e.g., show in FIGS. 7 and 8), will now be described.

As shown in FIG. 9A, an exemplary embodiment of a support plate 442 can include one or more support means (e.g., 446) for simply, easily, and inexpensively supporting an underside of the glass/ceramic heating element 422 such that the element 422 will not be damaged by items loaded on the glass/ceramic heating element 422 of the warming drawer module 404. The support means (e.g., 446) can minimize an amount of thermal and/or electrical contact area between the support means (e.g., 446) and the underside of the glass/ceramic heating element 422. For example, the support means (e.g., 446) can simultaneously minimize an amount of contact between that support means (e.g., 446) and the underside of the glass/ceramic heating element 422, which also may minimize heat transfer away from the glass/ceramic heating element 422 in a downward direction (i.e., in a direction away from the items to be warmed, which is an undesired direction for heat transfer), and which may minimize an amount of contact area of the support plate 442 that will need to be electrically insulated from the conductive underside of the glass/ceramic heating element 422. The support means (e.g., 446) also can control a height of the glass/ceramic heating element 422 above a surface of a support plate 442 (i.e., suspend the heating element 422 above the support plate 442) to provide a predetermined height or clearance for a thermostat 450 and thermostat retainer 460 (e.g., as shown in FIG. 7) to be disposed under the glass/ceramic heating element 422 and in contact with the underside of the glass/ceramic heating element 422. Exemplary embodiments of a thermostat 450 and thermostat retainer 460 will be described in greater detail with reference to FIGS. 10-13D. By controlling the height of the glass/ceramic heating element 422 above the surface of the support plate 442, the support means (e.g., 446) also can provide sufficient space for wire routing between the glass/ceramic heating element 422 and the metal support plate 442, for example, to route the wires 423 of the heating panel 422.

As shown in FIGS. 9A and 9B, an exemplary support plate 442 can include one or more supporting means or features, such as a plurality of embosses 446 for supporting (e.g., evenly and distributively supporting) the underside of the glass/ceramic heating element 422 at a predetermined distance above the support plate 442, while also minimizing thermal and electrical contact areas between the heating element 422 and the support plate 442. The plurality of embosses 446 can be disposed in various arrangements, patterns, and distributions on the support plate 442 to support the heating element 422 depending on the size and shape of the heating element 422. The embosses can be evenly spaced with respect to each other such that the embosses 446 provide equal support for each of the edges of the glass heating element 422 near the corners of the heating element 422, and particularly, for example, in areas in which the frame 416 will clamp down on the glass heating element 422 during assembly, thereby reducing or preventing damage to the glass/ceramic heating element 422, for example, during assembly of the warming drawer module 404. The support plate 442 can include a metal support plate, such as a stainless steel support plate or other suitable heat resistant material, that is capable of being embossed using an emboss tool. In other embodiments, the support plate 442 can be formed from other materials such as, for example, other heat resistant materials that are capable of being formed by embossing, casting, or molding processes.

The support plate 442 also can include one or more features for securing the support plate to other components of the warming drawer module (e.g., 404 in FIG. 7), such as one or more tabs 448 and/or one or more openings or slots 449 for engaging a rear portion and/or front portion of the drawer slides (e.g., 424 shown in FIG. 7). The support plate 442 can include one or more openings 444, for example, for guiding wires (e.g., 423 in FIG. 8)(e.g., power supply lines, control lines, and/or electrical connectors) of the glass/ceramic heating element from the space provided by the embosses 446, for example, to the control panel (e.g., 412 in FIG. 7). The embosses 446 can control a height of the glass/ceramic heating element 422 above a surface of the support plate 442 to provide a predetermined height or clearance for routing the wires between the glass/ceramic heating element and the metal support plate 442. A grommet (not shown) can be provided in the opening 444 to protect the wires from damage or wear from contacting an edge of the opening 444.

FIG. 9B shows an enlargement of an exemplary emboss 446 in FIG. 9A. The emboss 446 can include, for example, an upper surface 446*a* (e.g., having a substantially horizontal planar surface or a rounded surface) for supporting the underside of the glass/ceramic heating element 422, a plurality of side surfaces 446*b* (e.g., tapered or rounded side surfaces), and a plurality of tapered or rounded corners 446*c*. The embosses 446 of the support plate can have a variety of shapes and/or profiles that are capable of supporting the underside of the glass heating element 422.

With reference to FIGS. 9A and 9C, the support plate 442 can include one or more openings 447 configured to receive or engage one or more thermostat retainers 460 that support and fix one or more thermostats 450 (described in greater detail with reference to FIGS. 10-13D) in the space provided by the embosses 446 and in a predetermined position and height above the surface of the support plate 442 such that the thermostat 450 is against the underside of the glass heating element (e.g., 422 in FIG. 8). The opening 447, for example as illustrated in FIG. 9C, can include a circular opening having one or more notches or key cutouts 447*a* (hereinafter "key cutouts") formed in a perimeter of the opening to engage a corresponding feature of a thermostat retainer (e.g., 460 described with reference to FIGS. 10-13D below) and limit or prevent rotation of the thermostat retainer in the opening 447. As shown in the examples illustrated in FIGS. 9D-9G, the opening 447 can include a plurality of key cutouts 447*a*, 447*b* formed in a perimeter of the opening at a variety of positions to engage a plurality of corresponding features of a thermostat retainer and limit or prevent rotation of the thermostat retainer in the opening 447. The opening 447 can include any number of key cutouts, such as one, two, three, etc., which can be disposed as a variety of locations around the perimeter of the opening 447 for engaging corresponding features on a thermostat retainer to prevent rotation.

In other embodiments, for example when more than one type of thermostat and/or retainer is being used, the arrangement of the cutouts (e.g., 447*a*, 447*b*) can be different for one or more openings 447 and the corresponding key features of one or more thermostat retainers also can be different, for example, based on a type of thermostat. In this way, one or more of the openings 447 can be configured to correspond only to a particular key arrangement of a particular thermostat retainer, thereby ensuring that each respective thermostat can only be installed in a single, correct location on the support plate 442 and simplifying the manufacturing process.

The exemplary embodiments are not limited to arrangements in which the opening 447 has key cutouts 447*a*, 447*b* for preventing rotation of the thermostat retainer. In other embodiments, one or more openings 447 can have other perimeter shapes, for example, that can limit or prevent rotation of a corresponding thermostat retainer by virtue of their shape and without a key cutout 447*a*, 447*b*. For example, an opening 447 can have a perimeter shape that is oval, rectangular, square, hexagonal, etc. that will prevent a correspondingly-shaped thermostat retainer 460 from rotating in the opening 447, thereby fixing the position of the thermostat 450 with respect to the opening 447 of the support plate 442 without additional corresponding key features formed on the thermostat retainer 460 and/or the opening 447.

With reference to FIGS. 10-13D, exemplary embodiments of a thermostat and thermostat retainer will now be described.

Figure 10:
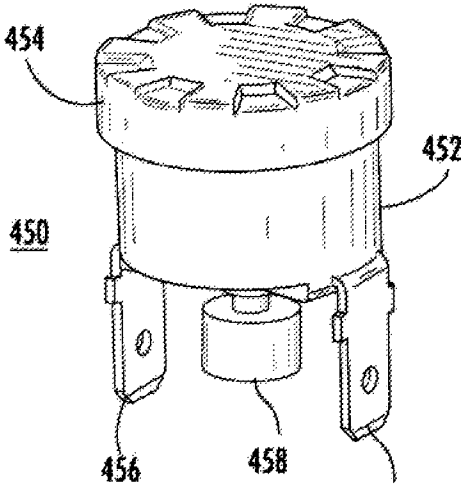
FIG. 10 is a perspective view of a thermostat according to an exemplary embodiment of the invention.
Figure 12B:
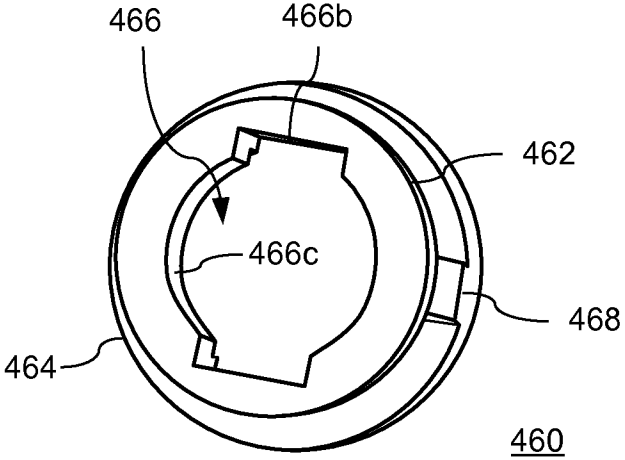
FIGS. 12A-12C are a top perspective view, bottom perspective view, and another bottom perspective view, respectively, of a thermostat retainer according to an exemplary embodiment of the invention.
Figure 12C:
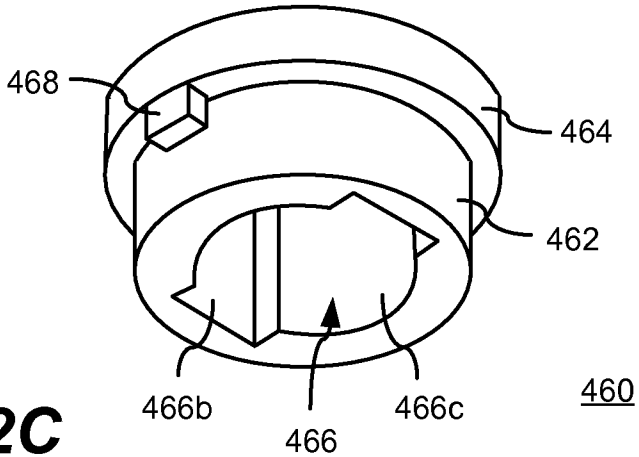
Figure 12A:
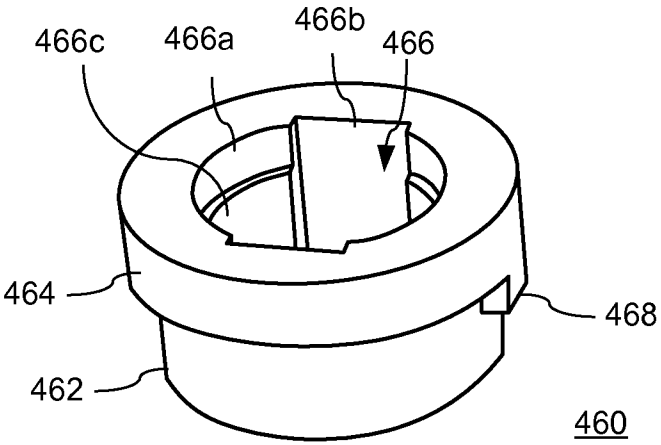
Figure 12D:
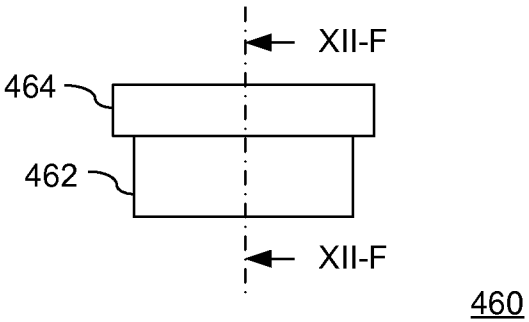
FIGS. 12D-12G are a side view, a top view, a cross-sectional view taken along line XII-F of FIG. 12D, and a bottom view, respectively, of a thermostat retainer according to an exemplary embodiment of the invention.
Figure 12E:
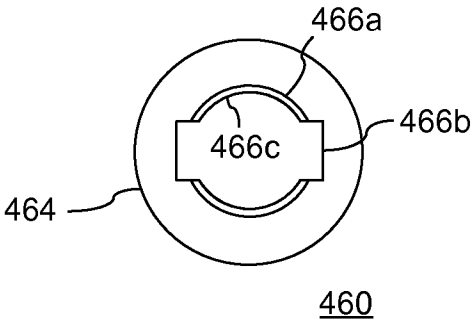
Figure 12F:
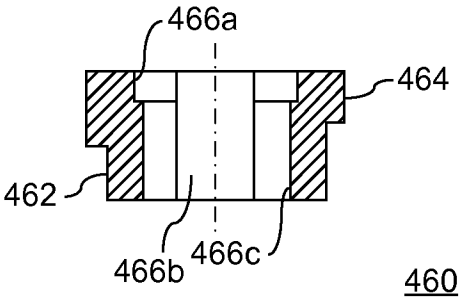
Figure 12G:
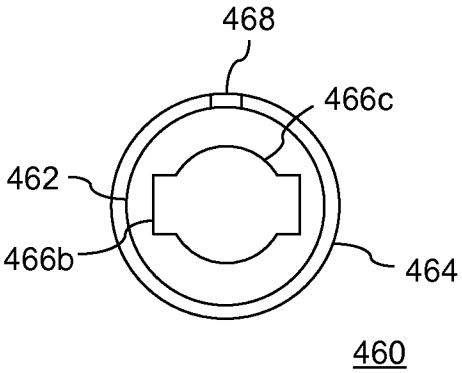

FIG. 10 illustrates an example of a thermostat 450 (e.g., off-the-shelf thermostat) that may be suitable for measuring the temperature of a heating element for a warming drawer. The thermostat 450 may include a cylindrical body 452 and a sensor 454 (i.e., temperature sensing surface) on an end of the body 452. A pair of electrical terminals 456 can extend from an opposite side of the body 452 from the sensor 454. The thermostat 450 can include a manual reset button 456 extending from the opposite side of the body 452 from the sensor 454 and being disposed between the terminals 456. The sensor 454 can have a larger diameter than the cylindrical body 452. Ordinarily, in operation, the thermostat 450 may be disposed directly in an opening on a part such that the body 452 extends into the opening and the sensor 454, which has a larger diameter, rests on a surface surrounding the opening, which has a smaller diameter than the sensor 454. Since the thermostat 450 commonly has a cylindrical body 452 and a cylindrical sensor 454. The thermostat 450 may be capable of rotating within the opening. Such rotation may not be a problem in some applications, for example, when the components of the assembly are stationary. However, in other instances, such an ability to rotate may be undesirable. For example, in a case of a warming drawer module (e.g., 404 as shown in FIGS. 4-7) that is movable with respect to a warming drawer housing (e.g., 402 in FIGS. 4-7), a movement of the warming drawer module may cause some of the wires that connect various electrical components such as the thermostat 450 to be moved or tugged, which may cause the sensor 454 to lose contact with the heating element, have insufficient contact with the heating element, be displaced from the opening 447, and/or result in wear/failure of the sensor 454, among other things.

Figure 11B:
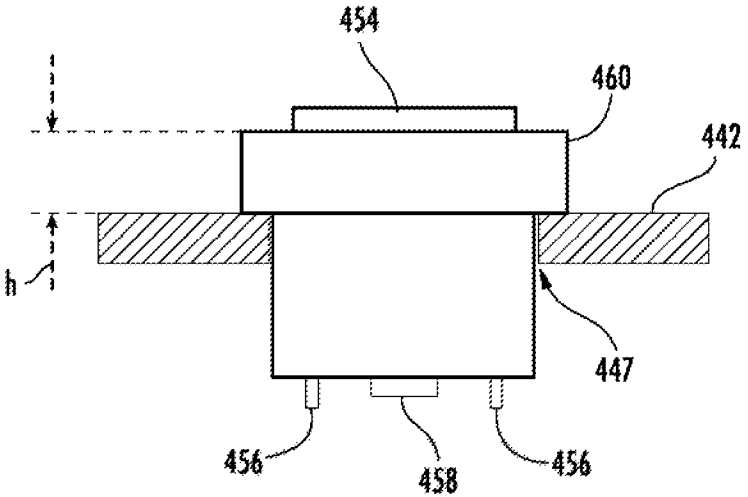
FIG. 11B is a partial side view and partial cross-sectional view of the assembly of the thermostat and thermostat retainer of FIG. 11A in an opening of a support plate according to an exemplary embodiment of the invention.
Figure 11A:
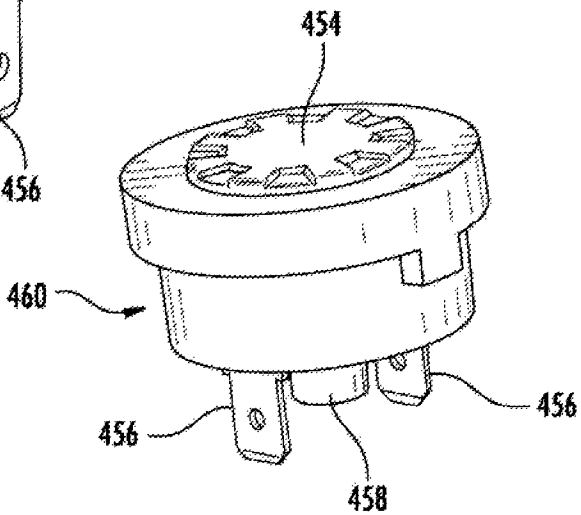
FIG. 11A is a perspective view of an assembly of a thermostat and thermostat retainer.

FIG. 11A illustrates an example of an assembly of a thermostat 450 and a thermostat retainer 460 according to the exemplary embodiments. FIG. 11B illustrates an example of the assembly of the thermostat 450 and the thermostat retainer 460 of FIG. 11A disposed in an opening 447 of the support plate 442 to accurately position, support, and fix the thermostat 450 in a predetermined position or height h with respect to the support plate 442 and/or the underside of the glass/ceramic heating element 422.

With reference to FIGS. 12A-12G, an exemplary embodiment thermostat retainer 460 will now be described.

The retainer 460 can include means (e.g., 466) for receiving and securing the thermostat 450 in the retainer 460. The retainer 460 can include means (e.g., 466*a*, 466*c*) for preventing the thermostat 450 from passing through the retainer 460 and means (e.g., 466*b*) for preventing the thermostat 450 from rotating with respect to the retainer 460. The retainer 460 can include means (e.g., 462) for engaging the opening (e.g., 447 in FIG. 11B) in the support plate and means (e.g., 464) for preventing the retainer 460 from passing through the opening 447 of the support plate 442 when installed from above the support plate 442. The retainer 460 can include means (e.g., 468) for preventing the retainer 460 from rotating with respect to the opening 447 of the support plate 442. The retainer 460 can include means (e.g., 464 and/or 466*a*) for accurately positioning the sensing surface 454 of the thermostat 450 at a predetermined height (e.g., h in FIG. 11B) above the support plate 442 such that the sensing surface 454 thermally contacts the underside of the glass/ceramic heating element 422 in an assembled state.

As shown in FIGS. 12A-12G, the thermostat retainer 460 can include, for example, a first body portion (e.g., 462) and a second body portion (e.g., 464) arranged in series in an axial (longitudinal) direction of the retainer 460. The second body portion (e.g., 464) can have a larger width (lateral) dimension in a direction perpendicular to the axial direction than the first body portion (e.g., 462). With reference again to FIG. 11B, the width dimension of the first body portion (e.g., 462) can be substantially equal to or less than a dimension of the opening 447 in the support plate 442 to permit the first body portion (e.g., 462) to extend into the opening 447 when the retainer 460 is inserted into the opening 447 in the support plate 442 from above. Particularly, the width dimension of the first body portion (e.g., 462) can be substantially equal to the dimension of the opening 447 within a predetermined tolerance that permits the second body portion to fit into the opening 447 with limiting movement in the lateral direction (i.e., direction perpendicular to the axial direction).

With reference again to FIG. 11B, the width dimension of the second body portion (e.g., 464) can be larger than a dimension of the opening 447 in the support plate 442 to prevent second body portion (e.g., 464) from passing through the opening 447 when the retainer 460 is inserted into the support plate 442 from above, thereby positioning and securing the retainer 460 in the opening 447 of the support plate 442. In this way, the second body portion extends radially outward from the first body portion to form a shoulder that abuts a surface of the sheet metal of the support plate 442, thereby limiting an amount that the retainer 460 passes into the opening 447 in the support plate 442. In other embodiments, the second body portion can have a different shape and/or be larger than the first body portion to prevent the retainer 460 from passing through the opening 447 to the other side of the support plate 442.

More particularly, with reference again to the example in FIGS. 12A-12G, the first body portion can be a first cylindrical body portion 462 and the second body portion can be a second cylindrical body portion 464. The first cylindrical body portion 462 and the second cylindrical body portion 464 can be arranged in series in an axial (longitudinal) direction of the retainer 460. The second cylindrical body portion 464 can have a diameter in a direction perpendicular to the axial direction (lateral direction) that is greater than a diameter of the first cylindrical body portion 462. With reference again to FIG. 11B, the diameter of the first cylindrical body portion 462 can be substantially equal to or less than a diameter of a circular opening 447 in the support plate 442 to permit the first cylindrical body portion 462 to extend into the opening 447 when the retainer 460 is inserted into the opening 447 in the support plate 442. The diameter of the second cylindrical body portion 464 is larger than a diameter of the circular opening 447 in the support plate 442 to prevent the second cylindrical body portion 464 from passing through the opening 447 when the retainer 460 is inserted into the support plate 442, thereby positioning and securing the retainer 460 in the opening 447 of the support plate 442. In this way, the second cylindrical body portion 464 extends radially outward from the first cylindrical portion to form a shoulder that abuts a surface of the sheet metal of the support plate 442, thereby limiting an amount that the retainer 460 passes into the opening 447 in the support plate 442. A thickness or height of the second cylindrical body portion 464 in an axial direction can be predetermined to control the desired height of the sensor 454 above the surface of the support plate 442. In other embodiments, a plurality of retainers 460 having second cylindrical body portions 464 with different heights can be provided such that a technician can select from among the available heights to provide a correct placement of the sensor 454 for a particular assembly or application.

As explained with reference to FIGS. 9A-9G, the support plate 442 can include one or more openings 447 that are adapted to receive the retainer 460. The opening 447 can include a circular opening having one or more key cutouts 447*a*, 447*b* formed in a perimeter of the opening 447. With reference to FIGS. 12A-12G, the retainer 460 can include one or more protrusions or keys 468 (hereinafter "keys") extending from the first cylindrical body portion 462 and/or the second cylindrical body portion 464 such that one or more keys 468 engage one or more corresponding cutouts 447*a*, 447*b* of the opening 447 when the retainer 460 is inserted in the opening 447. In this way, the cylindrical shaped retainer 460 can be prevented from rotating within the opening 447 about the longitudinal axis of the retainer 460, which extends in a direction perpendicular to the plane of the support plate 442. One of ordinary skill will recognize that in other embodiments, the opening 447 can include a key projecting radially inward from the perimeter of the opening 447 and the retainer 460 can include a corresponding cutout extending radially inward into one of the first and second cylindrical body portions.

With reference again to FIGS. 12A-12G, the retainer 460 can include an internal cylindrical bore 466 extending in an axial direction of the retainer 460 that is configured to receive the thermostat 450 when inserted from above. The bore 466 can include, for example, a pair of opposing cutouts or notches 466*b* that are configured to receive corresponding protrusions or keys on the thermostat 450. In the example, the existing terminals 456 of the thermostat 450 can function as the keys that engage the notches 466*b* of the bore 466. The engagement of the keys (e.g., terminals 456) in the notches 466*b* can prevent the thermostat 450 from rotating within the retainer 460 about the longitudinal axis of the thermostat 450. In other instances in which the thermostat 450 may have a shape other than a cylindrical shape, such as a square or rectangular shape, the internal bore correspondingly can be provided with a square or rectangular internal bore shape.

As explained with reference to FIG. 10, the thermostat 450 can have a sensor 454 with a larger diameter than the cylindrical body 452. With reference again to FIGS. 12A-12G, the internal cylindrical bore 466 can include a first bore portion 466*a* and a second bore portion 466*c* arranged in series in an axial (longitudinal) direction of the retainer 460. The first bore portion 466*a* can have an internal diameter in a direction perpendicular to the axial direction that is greater than a diameter of the second bore portion 466*c*, thereby forming an internal shoulder for engaging a corresponding shoulder formed by the intersection of the body portion 452 and the sensor 454 of the thermostat 450 shown in FIG. 10.

More particularly, with reference again to FIGS. 10 and 12A-12G, the diameter of the second bore portion 466*c* can be substantially equal to or greater than a diameter of the cylindrical body 452 of the thermostat 450 to permit the body 452 to extend into the second bore portion 466*c* when the thermostat 450 is inserted into the bore 466 of the retainer 460. The diameter of the second bore portion 466*c* can be less than a diameter of the sensor 454 of the thermostat 450 to prevent the sensor 454 from extending into the second bore portion 466*c* when the thermostat 450 is inserted into the bore 466 of the retainer 460.

In an embodiment, the diameter of the first bore portion 466*a* can be substantially equal to or greater than a diameter of the sensor 454 of the thermostat 450 to permit the sensor 454 to extend at least partially into the first bore portion 466*a* when the thermostat 450 is inserted into the bore 466 of the retainer 460, as shown for example in FIGS. 11A and 11B. In this way, the retainer 460 can at least partially enclose the thermostat 450 within the bore 466, thereby protecting the thermostat 450 from damage, etc. A depth from a top of the retainer 460 in the axial direction to the shoulder formed by the intersection of the first bore portion 466*a* and the second bore portion 466*c* can be a predetermined distance that is equal to or less than a thickness in the axial direction of the sensor 454 of the thermostat 450, such that the sensor 454 is flush with the top of the retainer 460 or extends partially above the top of the retainer 460 in an assembled state to permit the sensor to thermally contact the heating element.

In other embodiments, the internal cylindrical bore 466 can have a single bore portion that is greater than or equal to the diameter of the body portion 452 of the thermostat 450 and less than a diameter of the sensor 454 of the thermostat 450 such that the body portion 452 of the thermostat 450 extends into the bore 466 and the sensor 454 rests on top of the retainer 460 without passing into the bore 466 of the retainer 460.

With reference to FIGS. 13A-13D, the retainer 460 can include one or more keys 468*a*, 468*b* and/or arrangements of keys 468*a*, 468*b*. For example, the number, size, shape, and arrangement of keys 468*a*, 468*b* can correspond to one or more of the arrangements of the openings 447 and notches or key cutouts 447*a*, 447*b* formed in a perimeter of the opening 447, for example as shown in FIGS. 9A-9G. The retainer 460 can include any number of keys 468*a*, 468*b*, such as one, two, three, etc., which can be disposed as a variety of locations around the perimeter of the retainer 460 for engaging corresponding cutouts 447*a*, 447*b* of the opening 447 to prevent rotation. In other embodiments, for example when more than one type of thermostat and/or retainer is being used, the arrangement of the keys 468*a*, 468*b* of one more retainers 460 can be different and the corresponding cutouts (e.g., 447*a*, 447*b*) of one or more openings also can be different, for example, based on a type of thermostat. In this way, one or more of the openings 447 can be configured to correspond only to a particular key arrangement 468*a*, 468*b* of a particular thermostat retainer 460, thereby ensuring that each respective thermostat 450 and retainer 460 can only be installed in a single, correct location on the support plate 442, which may simplify the manufacturing process.

The exemplary embodiments are not limited to arrangements in which the retainer 460 has keys 468*a*, 468*b* for preventing rotation of the thermostat retainer 460. In other embodiments, one or more portions of the retainer 460 (e.g., the first portion 462 and/or the second portion 464) can have other perimeter shapes, for example, that can limit or prevent rotation of the retainer 460 in the opening 447 by virtue of their shape and without a key 468*a*, 468*b* on the retainer 460 or a cutout 447*a*, 447*b* on the opening 447. For example, the retainer 460 and the opening 447 can have corresponding perimeter shapes that are oval, rectangular, square, hexagonal, etc. that will prevent the retainer 460 from rotating in the correspondingly-shaped opening 447, thereby fixing the position of the thermostat 450 with respect to the opening 447 of the support plate 442 without additional corresponding key and/or cutout features formed on the thermostat retainer 460 and/or the opening 447.

The thermostat retainer 460 can be formed from a material that is resistant to temperature and/or electrically insulating. For example, the retainer 460 can be formed from a UL approved flame-rated temperature resistant resin having electrical insulation properties. In this way, the retainer 460 can insulate the thermostat 450 from the metal support plate 442.

With reference to FIG. 14A-16C, a process of assembling a warming drawer module, and an assembled warming drawer module, will now be described.

Figure 14A:
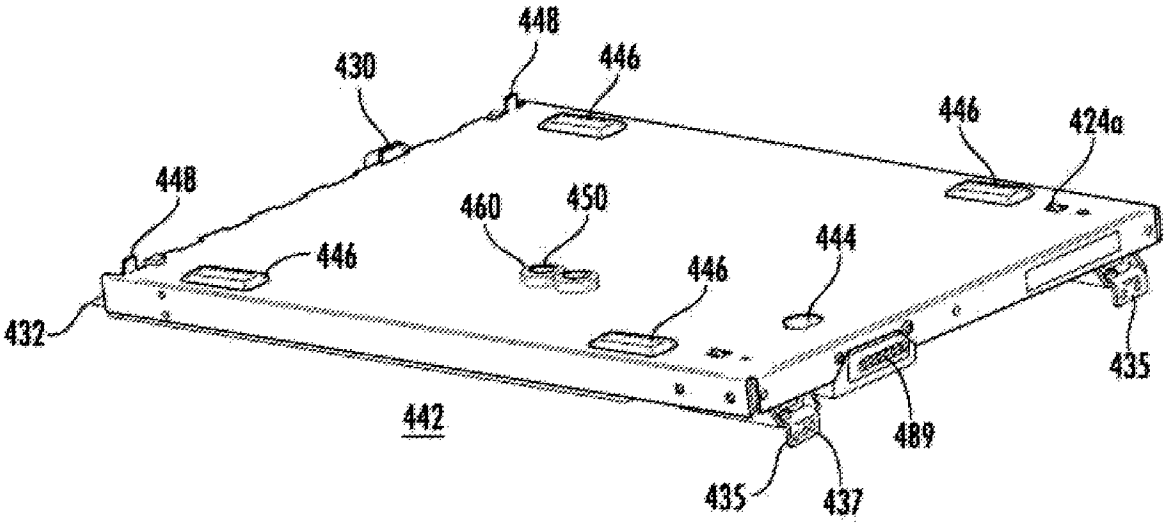
FIG. 14A is a perspective view of a support plate and FIG. 14B is a perspective view of a support plate having a thermally conductive sheet, according to an exemplary embodiment of the invention.

As shown in FIG. 14A, one or more thermostats 450 can be positioned on the support plate 442 using thermostat retainers 460 disposed in openings (e.g., 447 in FIGS. 9A and 11B) in the support plate 442 such that the thermostat 450 and retainer 460 are prevented by the retainer 460 from rotating about the longitudinal axis of the thermostat 450. The support plate 442 can includes a plurality of embosses 446 for supporting the underside of the glass/ceramic heating element (e.g., 422 in FIGS. 7 and 8) at a predetermined distance above the support plate 442, while also minimizing thermal and electrical contact areas between the heating element 422 and the support plate 442. The thermostat 450 is disposed in the space between a surface of the support plate 442 and an underside of the glass/ceramic heating element (not shown in FIG. 14A; see 422 in FIG. 8), and in thermal contact with the bottom surface of the glass/ceramic heating element 422 in order to monitor the temperature of the glass heating element 422 and provide a signal to a control unit of the warming drawer 404 for limiting or regulating the temperature of the heating element 422. The thermostat 450 can monitor the temperature of the glass heating element 422 to permit the control unit, for example of a control panel of the heating element 422, to control the operation of the heating element 422 (e.g., ON and OFF operation) in order to provide the selected temperature setting. An accurate determination of the true temperature of the heating element 422 can permit the control unit to consistently and accurately heat the heating element 422 to the selected temperature setting from one use to another use. In this way, a user can accurately select an appropriate temperature setting with an expectation that the warming drawer will function and heat the items to be warmed consistently from one use to the next use.

As shown in FIG. 14A, the support plate 442 can include one or more openings 444 for passing one or more wires, for example, from the heating element to a wire guide or channel on an underside of the support plate 442 or a wire guide 491 and an electrical connection 489. The electrical connection 489 can be connected, for example, to a corresponding electrical connection leading to a control unit (e.g., 412 in FIG. 7) in a front panel (e.g., 406 in FIG. 7) for controlling the heating element. FIG. 13A also shows some of the features for assembling the warming drawer shown in FIG. 7, such as a locking feature 432 at a rear portion of a U-shaped channel (e.g., 426 in FIG. 7) that engages or locks into a corresponding locking features (not shown) in the rear wall of the warming drawer housing (shown in FIG. 7), a front portion 435 of the U-shaped channel having openings 437 that can be secured (for example, with one or more screws) to a portion of the warming drawer housing at a location that is accessible to a user or technician from the front of the appliance in order to facilitate easy removal and replacement of the warming drawer module (e.g., 404 in FIG. 7) for repairs, replacement, modifications, and/or cleaning of the warming drawer module, and one or more tabs 448 for engaging a rear portion of a pair of drawer slides (e.g., 424 in FIG. 7).

Figure 14B:
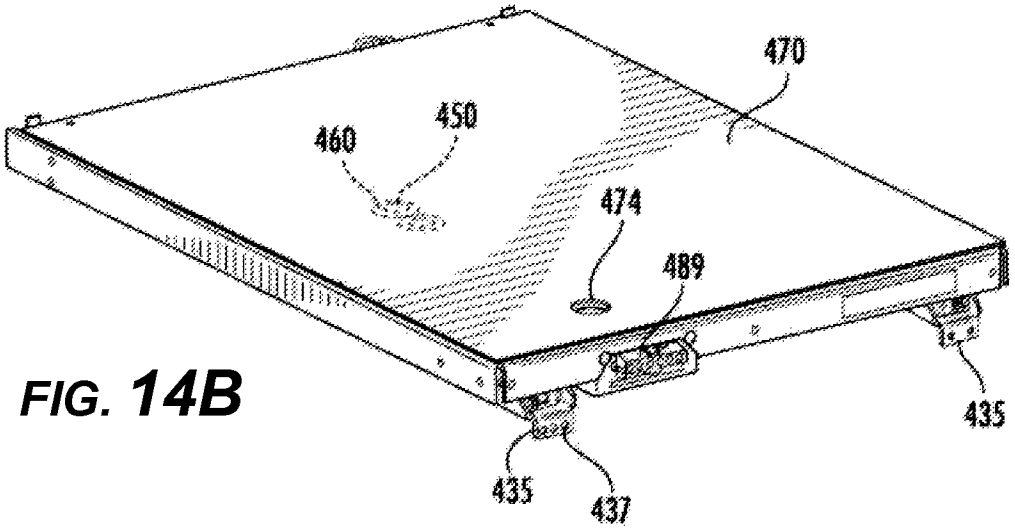
Figure 15A:
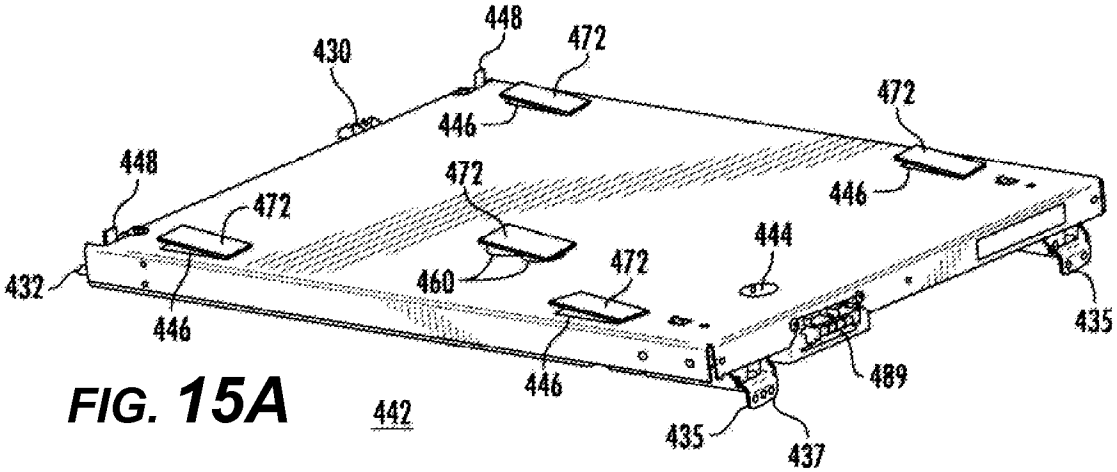
FIGS. 15A and 15B are perspective views of a support plate having a thermally conductive tape, according to an exemplary embodiment of the invention.
Figure 15B:
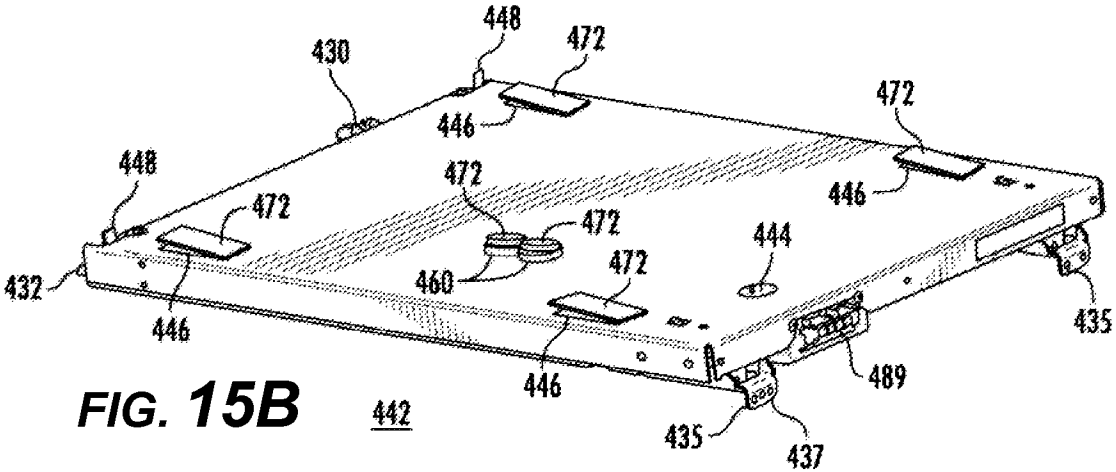

As shown in FIG. 14B, after the thermostat 450 and thermostat retainer 460 are installed on the support plate 442, a thermally conductive layer, such as a thermally conductive sheet 470, can be disposed over the entire support plate 442, including the sensor 454 of each thermostat 450, or at least the contact points between the thermostats 450 and/or the plurality of embosses 446, to thereby improve a thermal contact between the sensor 454 of each thermostat 450 and the underside of the heating element 422, and ensuring an accurate determination of a true temperature of the heating element 422. As shown in FIGS. 15A and 15B, in other embodiments, the thermally conductive layer can include individual portions of thermally conductive film or tape 472 at each location of the thermostats 450 and/or embosses 446, instead of a sheet 470. The individual portions of thermally conductive tape 472 can be disposed over each of the contact points between the conductive underside of the glass heating element 422 and the thermostats 450 and/or the plurality of embosses 446. The thermally conductive tape 472 can have a size a shape that covers, or at least corresponds to, a size and shape of one or more thermostats 450 or one or more embosses 446, as show in FIGS. 15A and 15B. The thermally conductive layer can be formed from a material having low thermal resistance (i.e., thermally conductive). The material forming the thermally conductive layer also advantageously can have high electrical resistance qualities, thereby electrically insulating each of the plurality of embosses from the underside of the electrically conductive underside of the heating element 422. The thermally conductive sheet 470 or thermally conductive tape 472 can include, for example, UL (Underwriter Laboratories) listed silicone electrically insulating material. The sheet 470 can include one or more openings 474 corresponding to one or more openings on the support plate 442, such as one or more openings 444 for passing the wires from the heating element to a wire guide or channel on an underside of the support plate 442.

Figure 16A:
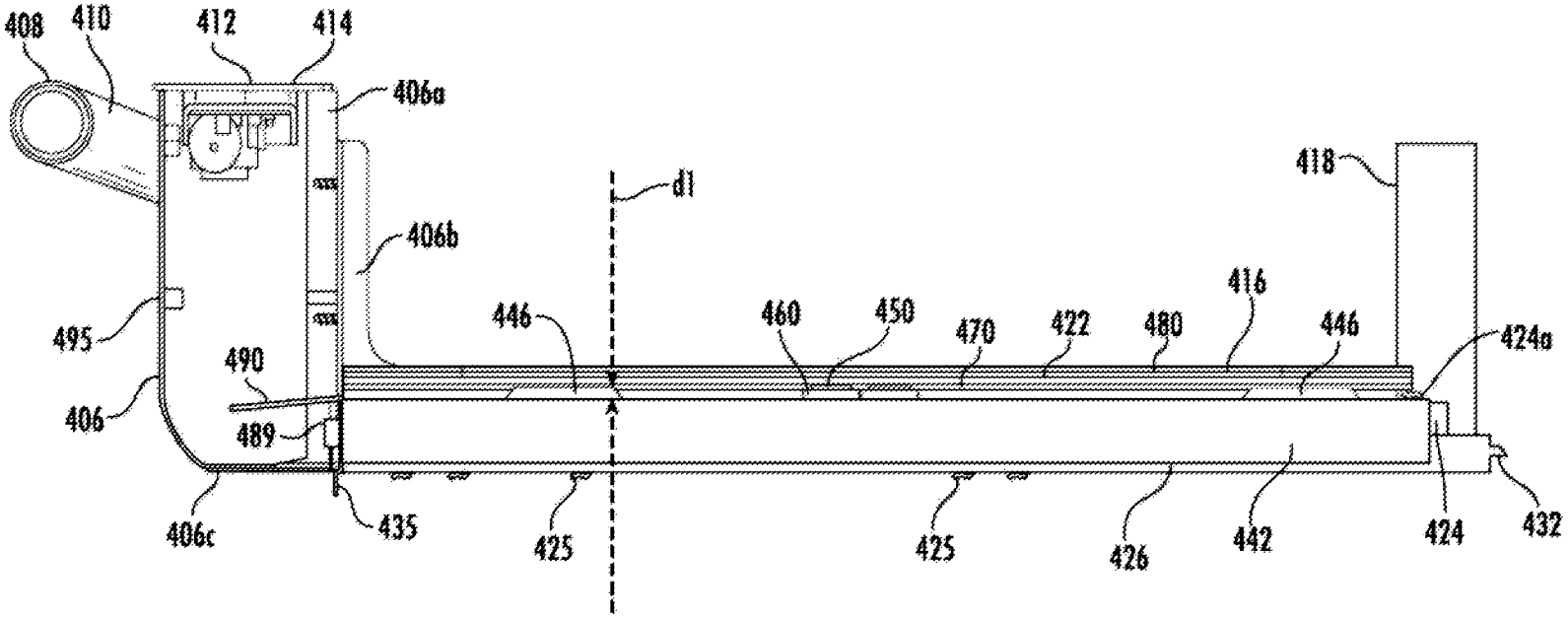
FIG. 16A is a schematic, cut-away side view of a warming drawer assembly according to an exemplary embodiment of the invention.
Figure 16B:
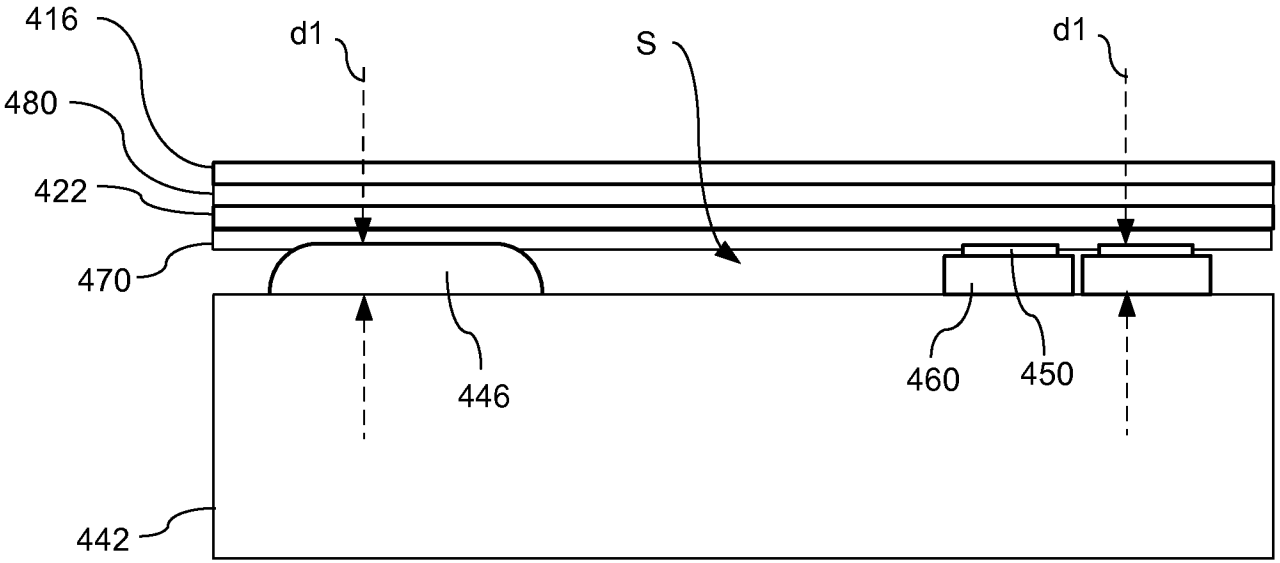
FIG. 16B is a schematic, cut-away partial side view of a warming drawer assembly according to the exemplary embodiment of FIG. 16A.
Figure 16C:
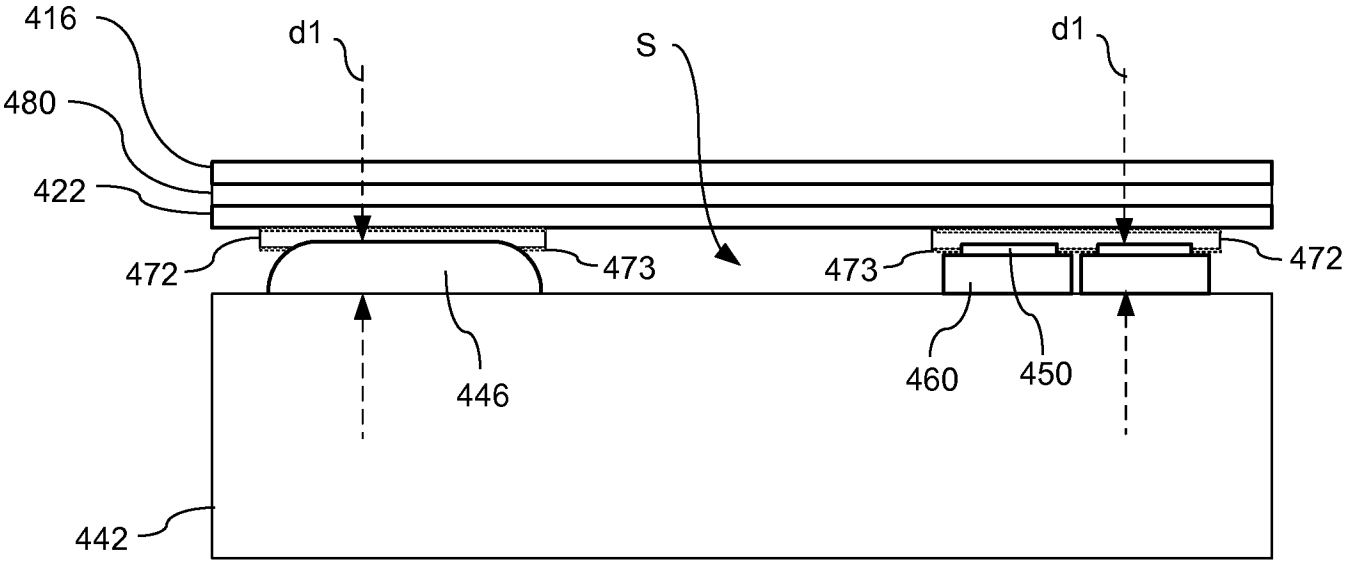
FIG. 16C is a schematic, cut-away partial side view of a warming drawer assembly according to another exemplary embodiment of the invention.

FIG. 16A illustrates a side, cut-away view of an assembled warming drawer module 404 according to the exemplary embodiment illustrated in FIG. 7, and having a thermostat 450 supported and fixed in position on the support plate 442 by a retainer 460, according to the exemplary embodiments illustrated, for example, in FIG. 11A-13D. FIGS. 16B and 16C are enlargements of several embodiments of the partial side view of FIG. 15A.

As shown in FIG. 16A, the assembled warming drawer module 404 can include a front panel 406 having a handle 408 coupled to the front panel 406 via handle mounts 410. The front panel 406 optionally can include a control panel 412 disposed in an opening or recess in an upper surface 414 of the front panel 406, and as another option, one or more indicator lights 495 (e.g., an LED indicator light) on a front surface of the front panel 406 to indicate when the warming drawer 400 is in operation, when the heating element is hot, etc. The front panel 406 can include a rear portion 406*a* that encloses a rear side of the front panel 406 and a bracket 406*b* for coupling the rear portion 406*a* to a front portion of a frame 416 of the warming drawer module 404. A rear portion of the frame 416 can be coupled to a rear panel 418 via brackets (not shown in FIG. 16A).

A drawer slide 424 can be coupled to a support plate 442 (e.g., stainless steel support plate), and particularly, for example, to the underside of the support plate 442. In the illustrated example, the slide 42 can include one or more projections 424*a* that engage corresponding openings (not shown in FIG. 16A) in the support plate 442. The channel 426 can be coupled to an underside of the slide 424. For example, the slide 42 can include one or more projections 425 on an underside of the slide 424 that engage corresponding openings in the U-shaped channel 426. FIG. 16A shows the locking feature 432 at a rear portion of the U-shaped channel 426 that engages or locks into a corresponding locking features (not shown) in the rear wall of the warming drawer housing, and a front portion 435 of the U-shaped channel 426 that can be secured (for example, with one or more screws) to a portion of the warming drawer housing at a location that is accessible to a user or technician from the front of the appliance in order to facilitate easy removal and replacement of the warming drawer module 404 for repairs, replacement, modifications, and/or cleaning of the warming drawer module 404.

As shown in FIGS. 16A and 16B, the exemplary warming drawer 400 can include a glass heating element 422 supported by a plurality of embosses 446 formed on the support plate 442. The glass heating element 422 can be supported by the plurality of embosses 446 at a predetermined distance d1 above the support plate 442, thereby minimizing thermal and electrical contact areas between the heating element 422 and the support plate 442. The warming drawer 400 can include one or more thermostat retainers 460 that support and fix one or more thermostats 450 such that a portion of each retainer 460 and the sensor of each thermostat 450 is disposed within the predetermined distance d1 between the upper surface of the support plate 442 and the underside of the glass heating element 422, which is provided by the embosses 446. The predetermined distance d1 can be selected to correspond to the particular height of the assembly of the thermostat retainer 460 and thermostats 450 to ensure that the sensor of the thermostat 450 obtains sufficient conductive contact with the underside of the heating element 422 to provide accurate temperature measurements of the true temperature of the heating element 422.

Each thermostat retainer 460 can support the sensor of the thermostat 450 in a predetermined position above the upper surface of the support plate 442 (for example, at a height that meets government and agency minimum electrical clearance requirements) such that the thermostat 450 is pressed upward against the underside of the glass heating element 422 when the warming drawer module 404 is in an assembled state. As shown in FIG. 16B, the thermally conductive sheet 470 can be disposed in a state of compression between the thermostat 450 and the underside of the glass heating element 422, which may further improve thermal contact between the sensor of the thermostat 450 and the underside of the glass heating element 422.

With reference again to FIGS. 16A and 16B, the glass heating element 422 is disposed over the thermally conductive sheet 470, the plurality of embosses 446 of the support plate 442, and the thermostats 450. The wires (not shown) of the heating element 422 can be guided in the space S between the upper surface of the support plate 442 and the underside of the glass heating element 422. An upper edge or perimeter surface of the glass heating element 422 can be covered by one or more gasket strips 480 for spills or liquids, which may form a gasket or seal between the glass heating element 422 and the frame 416. The frame 416 can be disposed over the gasket strips 480 and the glass heating element 422, and then secured to the support plate 442, thereby keeping spills or other liquids away from electrical components (e.g., 489 in FIG. 7) in the module 404.

FIG. 16C illustrates another embodiment having individual portions of thermally conductive film or tape 472 disposed at each location between the underside of the glass heating element 422 and the embosses 446 and/or thermostats 450, instead of a sheet 470. The individual portions of thermally conductive film or tape 472 can be disposed in a state of compression between each thermostat 450 (or group of thermostats 450) and the underside of the glass heating element 422, which may further improve thermal contact between the sensor of the thermostat 450 and the underside of the glass heating element 422. The thermally conductive tape 472 can include an optional adhesive layer (473 shown by dashed lines) on the surface adjacent to the thermostat 450 or the embosses 446 and/or the underside of the heating element 422.

The glass heating element 422 is disposed over the thermally conductive tape 472, the plurality of embosses 446 of the support plate 442, and the thermostats 450. The wires (not shown) of the heating element 422 can be guided in the space S between the upper surface of the support plate 442 and the underside of the glass heating element 422 to an opening (not shown in FIG. 16A; see 444 in FIGS. 14A-15B) for passing the wires from the heating element to a wire guide or channel on an underside of the support plate 442 and to an electrical connection 489 in an interior of the front cover 406. The electrical connection 489 can be connected, for example, to a corresponding electrical connection leading to a control unit 412 in the upper surface 414 of the front panel 406 for controlling the heating element.

An upper edge or perimeter surface of the glass heating element 422 can be covered by one or more gasket strips 480, which may form a gasket or seal between the glass heating element 422 and the frame 416. The frame 416 can be disposed over the gasket strips 480 and the glass heating element 422, and then secured to the support plate 442. As shown in FIG. 16A, the frame 416 can include a drip guard 490 to protect the electrical connector 489 from spills. For example, the drip guard 490 can guide spills, cleaning solutions, etc. from the upper surface of the glass heating element 422 and the frame 416 away from and around electrical components, such as the electrical connector 489, and/or the electrical components above or below the support plate 442 or on the glass heating element 422. A lower surface 406*c* of the front cover 406 also can include one or more openings (not shown) for draining fluids from the front cover 406 guided there by the drip guard 490.

In this way, the exemplary embodiments can provide simple, easy to manufacture, and inexpensive means (e.g., 466) for receiving and securing the thermostat 450 in the retainer 460, means (e.g., 466*a*, 466*c*) for preventing the thermostat 450 from passing through the retainer 460, means (e.g., 466*b*) for preventing the thermostat 450 from rotating with respect to the retainer 460, means (e.g., 462) for engaging the opening (e.g., 447 in FIG. 11B) in the support plate and means (e.g., 464) for preventing the retainer 460 from passing through the opening 447 of the support plate 442 when installed from above the support plate 442, means (e.g., 468) for preventing the retainer 460 from rotating with respect to the opening 447 of the support plate 442, means (e.g., 464 and/or 466*a*) for accurately positioning the sensing surface 454 of the thermostat 450 at a predetermined height (e.g., h in FIG. 11B) above the support plate 442 such that the sensing surface 454 thermally contacts the underside of the glass/ceramic heating element 422 in an assembled state for improving the thermal conductivity between the thermostat (e.g., 450) and an underside of the glass/ceramic heating element (e.g., 422), thereby ensuring that temperature limiting and regulating thermostat provides an accurate determination of the true and full temperature of the heating element, to thereby permit the control unit to consistently and accurately heat the heating element to the selected temperature setting from one use to another use, and to minimize the risk of, or to prevent, the heating element from exceeding a predetermined temperature that may result in damage or overheating of the heating element. The thermostat can provide accurate information of the true and full temperature (i.e., with limited temperature loss or without temperature loss) of the heating element such that the control unit can, if needed, shut down the heating element to prior to an occurrence of damage to, or overheating, of the heating element or the warming drawer, or adjacent components of the appliance. The exemplary embodiments of the present invention may simplify the manufacturing process and reduce labor and time for manufacturing, thereby reducing manufacturing costs.

In other embodiments, a household appliance can include a warming drawer with a fixed glass heating element. The warming drawer can include a support plate (e.g., 442) having support means (e.g., a plurality of embosses 446) supporting an underside of the heating element at a predetermined distance above the support plate.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A household appliance comprising:

a warming drawer housing having an interior chamber; and a warming drawer module in the interior chamber, the warming drawer module including:

a heating element forming a floor surface of the warming drawer module, the floor surface for receiving items to be warmed;

a support plate that supports the heating element in a position above the support plate, the support plate including a plate portion and a plurality of supports on the plate portion, the plurality of supports supporting an underside of the heating element at a predetermined distance above the plate portion and forming a space between the plate portion and the underside of the heating element;

a thermostat having a sensor measuring a temperature of the heating element, the thermostat disposed under the heating element; and a thermostat retainer disposed in an opening in the support plate, the thermostat retainer supporting and fixing the thermostat in thermal contact with the underside of the heating element.

2. The household appliance of claim 1, wherein the thermostat retainer comprises:

a first body portion having a first width dimension in a direction perpendicular to an axial direction of the first body portion; and a second body portion arranged in series with the first body portion in the axial direction of the thermostat retainer, the second body portion having a second width dimension in the direction perpendicular to the axial direction, the second width dimension being greater than the first width dimension, the first body portion and the second body portion cooperating to form a shoulder that prevents the second body portion from passing through the opening in the support plate, wherein one of the first body portion and the second body portion includes means for preventing rotation of the thermostat retainer in the opening in the support plate.

3. The household appliance of claim 2, wherein a first shape of the first body portion corresponds to a shape of the opening in the support plate, and wherein a second shape of the second body portion is different than the first shape of the first body portion and the shape of the opening in the support plate to prevent the thermostat retainer from passing through the opening.

4. The household appliance of claim 2, wherein a first size of the first body portion corresponds to a size of the opening in the support plate, and wherein a second size of the second body portion is different than the first size of the first body portion and the size of the opening in the support plate and prevents the second body portion from passing through the opening.

5. The household appliance of claim 2, wherein a first size of the first body portion is equal to or less than a size of the opening in the support plate, and wherein a second size of the second body portion is greater than the first size of the first body portion and the size of the opening in the support plate and prevents the second body portion from passing through the opening.

6. The household appliance of claim 2, wherein the first body portion includes a first cylindrical body portion and the second body portion includes a second cylindrical body portion, and wherein the second cylindrical body portion has a second diameter in the direction perpendicular to the axial direction that is greater than a first diameter of the first cylindrical body portion.

7. The household appliance of claim 2, wherein the second body portion has a predetermined thickness in the axial direction that controls a predetermined height of the thermostat above the support plate in an assembled state with the thermostat retainer.

8. The household appliance of claim 2, wherein the thermostat retainer is disposed in the opening, and wherein the means for preventing rotation of the thermostat retainer in the opening in the support plate includes a key extending from one of the first body portion and the second body portion, and the key engages a corresponding cutout formed on the opening in the support plate and prevents rotation of the thermostat retainer in the opening.

9. The household appliance of claim 2, wherein the thermostat retainer is disposed in the opening, and wherein the means for preventing rotation of the thermostat retainer in the opening in the support plate includes a cutout formed in one of the first body portion and the second body portion, and the cutout engages a corresponding key extending from the opening in the support plate and prevents rotation of the thermostat retainer in the opening.

10. The household appliance of claim 2, wherein the first body portion and the second body portion include an internal bore extending in the axial direction of the thermostat retainer, wherein the thermostat is disposed in the internal bore.

11. The household appliance of claim 10, wherein the internal bore includes a pair of opposing cutouts that engage corresponding keys on the thermostat and prevent rotation of the thermostat with respect to the internal bore.

12. The household appliance of claim 10, wherein the internal bore includes a pair of opposing cutouts that engage corresponding electrical terminals on the thermostat and prevent rotation of the thermostat with respect to the internal bore.

13. The household appliance of claim 10, wherein the internal bore includes a first bore portion and a second bore portion arranged in series in the axial direction, the first bore portion having a first internal dimension in the direction perpendicular to the axial direction that is greater than a second internal dimension of the second bore portion, the first bore portion and the second bore portion cooperating to form an internal shoulder that engages a corresponding shoulder of the thermostat.

14. The household appliance of claim 13, wherein a depth from a top of the second body portion in the axial direction to the internal shoulder formed by an intersection of the first bore portion and the second bore portion is a predetermined distance that is equal to or less than a thickness in the axial direction of a sensor of the thermostat, such that the sensor is one of flush with the top of the second body portion and extends partially above the top of the second body portion in an assembled state.

15. The household appliance of claim 1, wherein the thermostat retainer includes a temperature resistant and electrically insulating material.

16. The household appliance of claim 1, wherein the warming drawer module is movable between a first position in which the warming drawer module is in the interior chamber of the warming drawer housing and a second position in which a part of the warming drawer module is outside the warming drawer housing.

17. The household appliance of claim 1, wherein the heating element includes:

a glass ceramic surface having a conductive coating, the glass ceramic surface forming a warming surface that supports the items to be warmed, the conductive coating forming a circuit on an underside of the ceramic surface; and an electrical connection for supplying power to the circuit.

18. The household appliance of claim 16, wherein the heating element, the support plate, the thermostat, and the thermostat retainer are coupled to and movable with the warming drawer module between the first position and the second position.

19. A household appliance comprising:

a warming drawer housing having an interior chamber; and a warming drawer module in the interior chamber, the warming drawer module including:

heating means for heating items to be warmed and forming a floor surface of the warming drawer module, the floor surface for receiving the items to be warmed;

a support plate that supports the heating means in a position above the support plate, the support plate including:

a plate portion having an opening; and support means for supporting an underside of the heating means at a predetermined distance above the plate portion and forming a space between the plate portion and the underside of the heating means;

a thermostat having a body and a sensor on the body, the sensor measuring a temperature of the heating means, the thermostat disposed under the heating means; and retainer means for supporting the body of the thermostat and fixing the sensor of the thermostat in thermal contact with the underside of the heating means, the retainer means disposed in the opening in the support plate.

20. The household appliance of claim 19, further comprising:

means for preventing the retainer means from rotating in the opening in the support plate.

* * * * *